US010562314B2

(12) United States Patent
Emi

(10) Patent No.: US 10,562,314 B2
(45) Date of Patent: Feb. 18, 2020

(54) FLOW PATH MEMBER AND LIQUID EJECTING APPARATUS

(71) Applicant: SEIKO EPSON CORPORATION, Tokyo (JP)

(72) Inventor: Yohei Emi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/951,519

(22) Filed: Apr. 12, 2018

(65) Prior Publication Data

US 2018/0297369 A1 Oct. 18, 2018

(30) Foreign Application Priority Data

Apr. 17, 2017 (JP) ..... 2017-081134
Dec. 27, 2017 (JP) ..... 2017-252174

(51) Int. Cl.
*B41J 2/175* (2006.01)
*B41J 2/14* (2006.01)
*B41J 2/19* (2006.01)

(52) U.S. Cl.
CPC ..... *B41J 2/17563* (2013.01); *B41J 2/14201* (2013.01); *B41J 2/175* (2013.01); *B41J 2/17509* (2013.01); *B41J 2/17523* (2013.01); *B41J 2/17596* (2013.01); *B41J 2/19* (2013.01)

(58) Field of Classification Search
None
See application file for complete search history.

(56) References Cited

U.S. PATENT DOCUMENTS

2010/0053286 A1* 3/2010 Ito ..... B41J 2/17509 347/93
2016/0059576 A1* 3/2016 Ito ..... B41J 2/17523 347/93
2016/0114592 A1 4/2016 Ishii et al.

FOREIGN PATENT DOCUMENTS

JP 2000-218809 A 8/2000
JP 2001-105620 A 4/2001
JP 2006-263996 A 10/2006
JP 2013-56480 A 3/2013
JP 2016-49725 A 4/2016
JP 2016-83927 A 5/2016

* cited by examiner

*Primary Examiner* — Matthew Luu
*Assistant Examiner* — Tracey M McMillion
(74) *Attorney, Agent, or Firm* — Workman Nydegger

(57) ABSTRACT

A flow path member includes a filter, a first space provided with an entrance through which a ink flows in, and a second space separated from the first space by the filter and that has an exit through which the ink flows out and a bottom surface facing the filter, in which the bottom surface includes an inclined surface spaced away from the filter from an end of the filter toward a center in a case where the filter is viewed in plan view, and the exit is in a middle of the inclined surface.

20 Claims, 19 Drawing Sheets

FLOW PATH MEMBER AND LIQUID EJECTING APPARATUS

BACKGROUND

1. Technical Field

The present invention relates to a technique that ejects a liquid such as ink.

2. Related Art

Various structures (flow path members) that supply a liquid to a liquid ejecting head which ejects the liquid such as an ink from a plurality of nozzles is proposed. For example, the flow path member described in JP-A-2016-049725 is provided with a second upstream flow path (first liquid flow path), an upstream filter chamber (first space), a filter, a downstream filter chamber (second space), and a third upstream flow path (second liquid flow path) in order from an upstream side where the liquid flows, and dot-shaped protrusions protruding from a bottom surface of the downstream filter chamber toward a filter side are further provided. The liquid which passes through the first liquid flow path, the first space, the filter, the second space, and the second liquid flow path, and from which a foreign matter is removed is supplied to a head body of a recording head (liquid ejecting head) via a downstream flow path member.

The dot-shaped protrusions suppress the filter from adhering to the bottom surface even in a case where the filter is pressed against a bottom surface side of the downstream filter chamber due to a pressure of a flowing liquid. As a result, a problem that an effective area (execution filtration area) of the filter is decreased and a pressure loss is increased is suppressed. Furthermore, by forming the protrusions in a dot shape and reducing sizes of the protrusions, it is difficult for bubbles mixed in the downstream filter chamber to be caught by the protrusions. As a result, discharge performance of the bubbles is improved.

However, when a structure portion protruding from the bottom surface of the downstream filter chamber toward the filter side is provided, the bubbles are likely to be caught by a structure. Therefore, it is difficult to completely suppress the bubbles from being caught even in a case where the structure is formed as the dot-shaped protrusions and a size of the structure is reduced. Therefore, in the flow path member described in JP-A-2016-049725, the bubbles are caught by the dot-shaped protrusions, and there is a possibility that the discharge performance of the bubbles deteriorates.

SUMMARY

The invention can be realized as a following form or application example.

APPLICATION EXAMPLE 1

According to this application example, there is provided a flow path member including a filter, a first space provided with an entrance through which a liquid flows in, and a second space separated from the first space by the filter and that has an exit through which the liquid flows out and a bottom surface facing the filter, in which the bottom surface includes an inclined surface spaced away from the filter from an end of the filter toward a center in a case where the filter is viewed in plan view, and the exit is in a middle of the inclined surface.

Since the bottom surface of the second space facing the filter is the inclined surface spaced away from the filter from the end of the filter toward the center in the case where the filter is viewed in the plan view, even in a case where the filter is pressed toward the bottom surface side of the second space due to the pressure of the flowing liquid, the filter is less likely to adheres to the bottom surface. Therefore, it is possible to suppress a problem that the bubbles are confined in a portion where the filter adheres to the bottom surface and discharge performance of the bubbles is deteriorated. In addition, it is possible to suppress a decrease in the execution filtration area of the filter due to the filter adhering to the bottom surface.

Furthermore, since the bottom surface is the inclined surface that is spaced away from the filter, the bubbles are not caught on the bottom surface of the second space unless a structure portion protruding toward the filter side is provided on the bottom surface of the second space. In addition, when the filter is pressed toward the bottom surface side of the second space due to the pressure of the flowing liquid and the distance between the filter and the inclined surface (bottom surface) is shortened, the cross sectional area of the flow path through which the liquid flows toward the exit decreases, and the flow (flow velocity) of the liquid becomes faster as compared with a case where the cross sectional area of the flow path is large. Therefore, in a case where the bubbles are contained in the liquid, the bubbles are likely to be quickly discharged from the exit without staying in the second space.

Therefore, it is possible to enhance the discharge performance of the bubble of the flow path member.

APPLICATION EXAMPLE 2

In the flow path member according to the application example, it is preferable that a width of the bottom surface gradually decrease with respect to an exit side than a side opposite thereto in the case where the filter is viewed in the plan view.

The second space is a space partitioned by the filter and the bottom surface, and the portion where the filter and the bottom surface are in contact with each other becomes the end of the second space, and is a contour of the bottom surface. Since the liquid flowing into the second space via the entrance, the first space, and the filter flows along the end of the second space, it is possible to control the flow direction of the liquid flowing into the second space by the end of the second space. In other words, the flow direction of the liquid flowing into the second space may be controlled by the contour of the bottom surface.

In the case where the filter is viewed in the plan view, the state where the width of the bottom surface gradually decreases with respect to the exit side corresponds to a state where the contour of the bottom surface narrows in the direction toward the exit on the exit side. Furthermore, in a case where the contour of the bottom surface narrows in a predetermined direction, a state where the direction toward the exit side gradually decreases than a side opposite thereto corresponds to a state where the exit side rapidly narrows than the opposite side.

Therefore, the area of the bottom surface decreases on the exit side and increases on the opposite side. Since the execution filtration area of the filter corresponds to the area of the bottom surface, when the area of the bottom surface increases on the opposite side, the execution filtration area of the filter may be increased. Therefore, it is possible to suppress the problem that the execution filtration area of the filter decreases and the pressure loss increases.

When the contour of the bottom surface narrows in the direction toward the exit at the exit side, the flow direction of the liquid is controlled by the contour of the bottom surface, so that the liquid flows in the direction toward the exit. That is, the liquid flowing in the second space is collected toward the exit, and is likely to be discharged from the exit. Therefore, in a case where the bubbles are contained in the liquid, the discharge performance of the bubbles may be enhanced.

APPLICATION EXAMPLE 3

According to this application example, there is provided a flow path member including a filter, a first space provided with an entrance through which a liquid flows in, a second space separated from the first space by the filter and that has a bottom surface facing the filter, and an exit disposed on the bottom surface and through which the liquid flows out, in which a width of the bottom surface gradually decreases with respect to an exit side than a side opposite thereto in a case where the filter is viewed in plan view.

The area of the bottom surface decreases on the exit side and increases on the opposite side. Since the execution filtration area of the filter corresponds to the area of the bottom surface, when the area of the bottom surface on the opposite side is increased, the execution filtration area of the filter may be increased. Therefore, it is possible to suppress the problem that the execution filtration area of the filter decreases and the pressure loss increases.

On the exit side, when the contour of the bottom surface narrows in the direction toward the exit, the liquid flows in the direction toward the exit. That is, the liquid flowing in the second space is collected toward the exit, and is likely to be discharged from the exit. Therefore, in a case where the bubbles are contained in the liquid, the discharge performance of the bubbles may be enhanced.

APPLICATION EXAMPLE 4

In the flow path member according to the application example, it is preferable that the bottom surface include a first portion where a width gradually decreases on the exit side, and a second portion that connects the exit and the first portion to each other and has the same width as that of the exit.

The liquid flowing into the second space is discharged from the exit via the first portion where the contour of the bottom surface narrows in the direction toward the exit and the second portion having the same width as that of the exit. That is, the liquid flowing into the second space is collected in the second portion by the first portion, and is discharged from the exit after the flow direction of the liquid is aligned in the direction toward the exit by the second portion.

Since the flow direction of the liquid toward the exit is aligned, as compared with the case where the flow direction of the liquid toward the exit is not aligned (for example, case where turbulent flow occurs), the liquid is likely to be discharged from the exit, and in a case where the bubbles are contained in the liquid, the discharge performance of the bubbles may be enhanced.

APPLICATION EXAMPLE 5

In the flow path member according to the application example, it is preferable that a contour of the bottom surface include a first contour forming a contour of the exit, a second contour different from the contour of the exit, and an intersection point of the first contour and the second contour, and in a case where a direction from a portion of the second contour farthest from the intersection point toward a portion of the first contour farthest from the intersection point is set as a first direction, the first contour be positioned on a side in the first direction with respect to the intersection point.

The liquid collected toward the intersection point (exit side) of the first contour and the second contour by the second contour is discharged from the exit. In other words, the liquid collected in the first direction by the second contour is discharged from the exit.

A state where the first contour is positioned on the side in the first direction with respect to the intersection point is a state where the exit is disposed at the end of the bottom surface in the first direction (portion where the bottom surface and the filter come into contact with each other). In a case where the exit is positioned at the center of the bottom surface, the liquid collected in the first direction may move in the second space exceeding the exit and not be discharged from the exit in some cases. On the other hand, when the exit is disposed at the end of the bottom surface in the first direction, the liquid collected in the first direction is reliably discharged from the exit without exceeding the exit, so that the liquid is likely to be discharged from the exit as compared with the case where the exit is disposed at the center of the bottom surface. Therefore, in a case where the bubbles are contained in the liquid, the discharge performance of the bubbles may be enhanced.

APPLICATION EXAMPLE 6

In the flow path member according to the application example, it is preferable that the intersection point be positioned on a side opposite to the first direction with respect to a center of the exit.

In a case where the liquid collected in the first direction is discharged from the exit, on the upstream side in the first direction at the exit, the length of the liquid flow path is shortened as compared with the downstream side in the first direction at the exit, and the resistance when the liquid flows decreases. Therefore, the flow of the liquid discharged from the exit becomes faster and the liquid is likely to be discharged from the exit. In addition, the upstream side in the first direction at the exit is on the side opposite to the first direction with respect to the center of the exit at the exit, and the downstream side in the first direction at the exit is the side in the first direction with respect to the center of the exit at the exit. Therefore, on the side opposite to the first direction with respect to the center of the exit at the exit, the flow of the liquid discharged from the exit becomes faster and the liquid is likely to be discharged from the exit, as compared with the side in the first direction with respect to the center of the exit at the exit.

On the side in the first direction with respect to the center of the exit at the exit, the flow of the liquid discharged from the exit is delayed, as compared with the side opposite to the first direction with respect to the center of the exit at the exit.

When the intersection point is positioned on the side opposite to the first direction with respect to the center of the exit, since the liquid collected toward the intersection point (exit side) by the second contour is directed to the side opposite to the first direction (side where the liquid flow is fast) with respect to the center of the exit at the exit, the liquid is likely to be discharged from the exit, as compared with the case where the liquid is directed toward the side in first direction (side where the liquid flow is slow) with respect to the center of the exit at the exit. Therefore, in a case where the bubbles are contained in the liquid, the discharge performance of the bubbles may be enhanced.

APPLICATION EXAMPLE 7

In the flow path member according to the application example, it is preferable that a fixing portion fixed to an end of the filter be provided on an outer side of an outer shape of the bottom surface in the case where the filter is viewed in the plan view.

In a case where the fibers are knitted to form a filter, when the fixing portion fixed to the end of the filter is provided, the fibers constituting the filter are less likely to be released at the end of the filter. For example, when the fibers constituting the filter are released, there is a possibility that the released fibers may be separated from the body of the filter and become a new foreign matter. In this application example, since the fibers constituting the filter are less likely to be released by the fixing portion, it is possible to suppress the possibility that the released fiber becomes the new foreign matter.

APPLICATION EXAMPLE 8

In the flow path member according to the application example, it is preferable that the filter be disposed along a direction intersecting a horizontal plane.

When the filter is disposed in a direction intersecting the horizontal plane, it is possible to shorten the dimension (width) in the direction intersecting the horizontal plane of the flow path member, as compared with a case where the filter is disposed along the horizontal plane.

APPLICATION EXAMPLE 9

In the flow path member according to the application example, it is preferable that the exit be positioned at an uppermost side in a gravity direction on the bottom surface.

When gas is contained in the liquid, the gas floats upward in the gravity direction due to buoyancy, so that when the exit is positioned at the uppermost side in the gravity direction on the bottom surface, the bubbles floating upward in the gravity direction by the buoyancy are likely to be discharged.

APPLICATION EXAMPLE 10

In the flow path member according to the application example, it is preferable that the inclined surface be along a deflection from the first space to the second space of the filter in a case where the liquid flows from the first space to the second space and the filter deflects from the first space toward the second space.

The liquid flows from the first space toward the second space, in a case where the filter deflects from the first space to the second space, the inclined surface (bottom surface) is along the deflection from the first space to the second space of the filter, so that the filter is less likely to adhere to the bottom surface. Therefore, it is possible to suppress the problem that the bubbles are confined in the portion where the filter adheres to the bottom surface, and the discharge performance of the bubbles is deteriorated. In addition, it is possible to suppress a decrease in the execution filtration area of the filter due to the filter adhering to the bottom surface.

APPLICATION EXAMPLE 11

In the flow path member according to the application example, it is preferable that a portion that is most spaced away from the filter of the bottom surface be a curved surface.

Since the portion most spaced away from the filter of the bottom surface becomes the curved surface, the bubbles are hardly caught in that portion, so that the discharge performance of the bubbles may be improved.

APPLICATION EXAMPLE 12

In the flow path member according to the application example, it is preferable that a flat surface inclined so as to approach the filter be continuous with the curved surface or a curved surface having a larger curvature than the curved surface continue between the portion that is most spaced away from the filter and the exit of the bottom surface.

Since the cross sectional area of the cross section intersecting the direction toward the exit may be decreased between the portion most spaced away from the filter and the exit of the bottom surface, the flow velocity may be increased, so the discharge performance of the bubbles may be improved.

APPLICATION EXAMPLE 13

According to this application example, there is provided a liquid ejecting apparatus including a flow path member according to above application example, and a nozzle that ejects liquid from the flow path member.

In the flow path member according to the above application example, since the discharge performance of the bubbles is enhanced, the liquid ejecting apparatus having the flow path member may suppress the bad effect of the bubbles, for example, the problem that the liquid is not properly ejected by the bubbles.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to the drawings. In the following drawings, a scale of each layer and each member is different from an actual scale in order to allow each layer and each member to be recognizable size.

Embodiment 1

Figure 1:
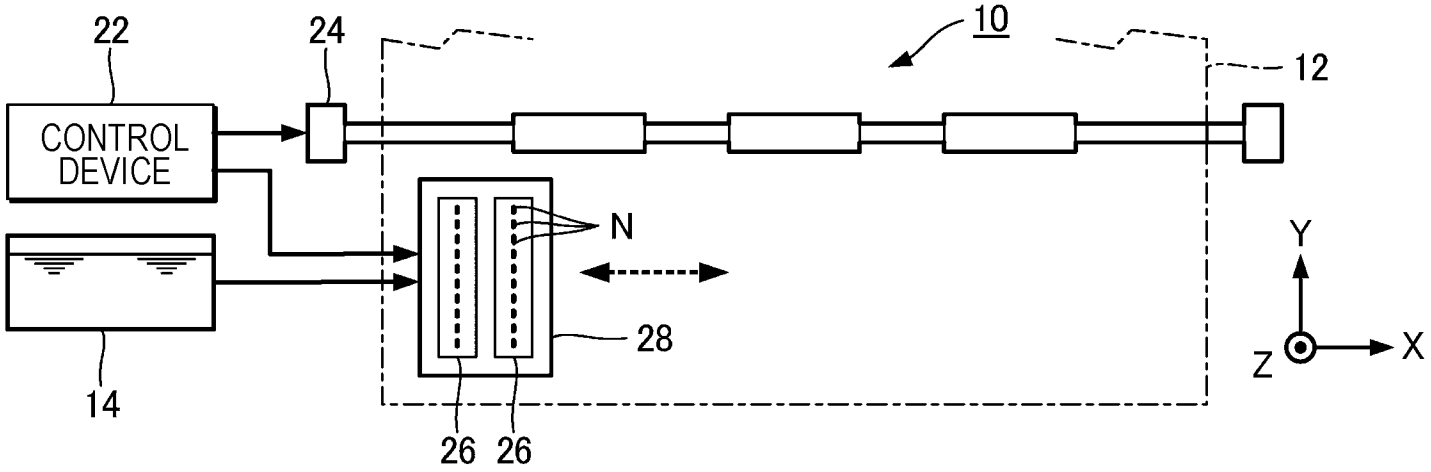
FIG. 1 is a partial configuration diagram of an ink jet type printing apparatus according to Embodiment 1.
Figure 2:
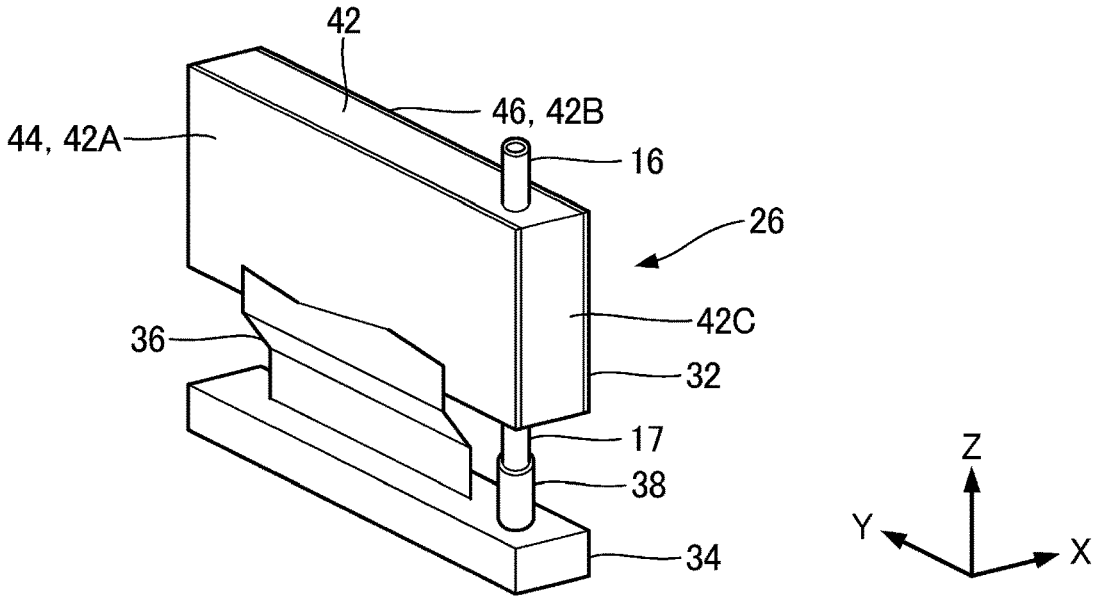
FIG. 2 is a perspective view of a certain liquid ejecting unit.

FIG. 1 is a partial configuration diagram of an ink jet type printing apparatus according to Embodiment 1. FIG. 2 is a perspective view of a certain liquid ejecting unit.

In FIGS. 1 and 2, X axis, Y axis, and Z axis are illustrated as three spatial axes orthogonal to each other. Among X axial directions along the X axis, the +X axial direction is a positive direction and the −X axial direction is a negative direction. Among Y axial directions along the Y axis, the +Y axial direction is a positive direction and the −Y axial direction is a negative direction. Among Z axial directions along the Z axis, the +Z axial direction is a positive direction and the −Z axial direction is a negative direction. That is, an arrow side of an arrow indicating the axial direction is the +direction (positive direction), and a base body end side is the −direction (negative direction). In addition, the XY plane is a horizontal plane, and the −Z axial direction is a gravity direction. Furthermore, the X, Y, and Z axes of FIGS. 1 and 2 correspond to the X, Y, and Z axes of the other drawings.

In addition, the X axial direction is a width direction of a printing apparatus 10, the Y axial direction is a depth direction of the printing apparatus 10, and the Z axial direction is a height direction of the printing apparatus 10.

As illustrated in FIG. 1, the printing apparatus 10 according to Embodiment 1 is an example of a "liquid ejecting apparatus", and ejects ink serving as an example of "liquid" onto a medium 12 such as a printing paper. The printing apparatus 10 is provided with a control device 22, a transport mechanism 24, a plurality of liquid ejecting units 26, and a carriage 28. Furthermore, a liquid container (cartridge) 14 storing ink is mounted on the printing apparatus 10.

The control device 22 integrally controls each element of the printing apparatus 10. The transport mechanism 24 transports the medium 12 in the −Y axial direction (sub scanning direction) under the control of the control device 22. The carriage 28 carries the liquid ejecting unit 26 and reciprocates in the X axial direction (main scanning direction) under the control of the control device 22. The liquid ejecting unit 26 ejects ink supplied from the liquid container 14 from each of a plurality of nozzles N to the medium 12 under the control of the control device 22.

The printing apparatus 10 alternately repeats an operation in which the liquid ejecting unit 26 ejects liquid while reciprocating in the X axial direction together with the carriage 28, and an operation of transporting the medium 12 in the −Y axial direction by the transport mechanism 24 to form a desired image on the medium 12.

As illustrated in FIG. 2, the liquid ejecting unit 26 is provided with a flow path member 32, a liquid ejecting head 34, and a wiring substrate 36.

The flow path member 32 is disposed on the side in the +Z axial direction with respect to the liquid ejecting head 34 and has a substantially rectangular parallelepiped shape in which the dimension in the X axial direction (dimension in the width direction) is shorter as compared with the dimension in the Z axial direction (dimension in the height direction) and the dimension in the Y axial direction (dimension in the depth direction). That is, the flow path member 32 is installed so that the dimension in the width direction is short and the dimension in the height direction is long.

In the following description, in a case where the flow path member 32 is installed such that the dimension in the width direction is short and the dimension in the height direction is long, the flow path member 32 is referred to as being disposed vertically. In addition, in a case where the flow path member 32 is installed such that the dimension in the width direction is long and the dimension in the height direction is short, the flow path member 32 is referred to as being disposed horizontally.

In the embodiment, the flow path member 32 is vertically disposed. By vertically disposing the flow path member 32, it is possible to shorten the width dimension of the liquid ejecting unit 26 and shorten the dimension in the width direction of the printing apparatus 10.

The liquid ejecting head 34 is a thin member that is disposed on the side in the −Z axial direction with respect to the flow path member 32 and whose dimension in the Z axial direction is shorter as compared with the dimension in the X axial direction and the dimension in the Y axial direction.

The flow path member 32 is provided with a base body 42 forming the main body of the flow path member 32, a sealing body 44 that seals a first surface 42A on the side in the −X axial direction of the base body 42, a sealing body 46 that seals a second surface 42B on the side in the +X axial direction of the base body 42, a supply flow path (supply port) 16, and a discharge flow path (discharge port) 17.

The supply flow path 16 is disposed on the side in the +Z axial direction with respect to the base body 42, and the discharge flow path 17 is disposed on the side in the −Z axial direction with respect to the base body 42. In addition, the surface on the side in the −Y axial direction (surface intersecting with the first surface 42A and the second surface 42B) of the base body 42 is a third surface 42C.

The flow path member 32 discharges the ink supplied from the liquid container 14 to the supply flow path 16 to the discharge flow path 17 via a flow path formed by sealing the surfaces 42A and 42B of the base body 42 with the sealing bodies 44 and 46.

The liquid ejecting head 34 is connected to the discharge flow path 17 of the flow path member 32 via a supply pipe 38. The liquid ejecting head 34 ejects the ink supplied from the discharge flow path 17 of the flow path member 32 via the supply pipe 38 from the plurality of nozzles N.

Specifically, the liquid ejecting head 34 has a plurality of pressure chambers (not illustrated) and piezoelectric elements (not illustrated) corresponding to different nozzles N. For example, a flexible wiring substrate 36 such as a flexible printed circuit (FPC) or a flexible flat cable (FFC) is connected to the liquid ejecting head 34. Wirings for supplying a drive signal and a power supply voltage to drive the respective piezoelectric elements to the liquid ejecting head 34 are formed on the wiring substrate 36. Ink filled in the pressure chamber is ejected from each nozzle N by vibrating the piezoelectric element in accordance with the drive signal and power supply voltage supplied via the wiring substrate 36 to vary the pressure inside the pressure chamber.

Since a portion of the member (for example, a resin tube) forming the flow path of the ink from the liquid container 14 to the nozzle N has base body permeability, when the printing apparatus 10 is used for a long period of time, there is a possibility that bubbles enter the ink in the flow path of ink from the liquid container 14 to the nozzle N.

If gas is mixed in the flow path of ink from the liquid container 14 to the nozzle N and the bubbles stay in the pressure chamber, pressure fluctuation in the pressure chamber by the piezoelectric element is inhibited, so that there is a possibility that the ink filled in the pressure chamber is not properly ejected from each nozzle N and the quality of the image formed on the medium 12 is deteriorated. Therefore, in the printing apparatus 10, a maintenance process (for example, flushing process) is periodically performed, and the bubbles mixed in the flow path of ink from the liquid container 14 to the nozzle N are forcibly discharged from the nozzle N to the outside.

Figure 3:
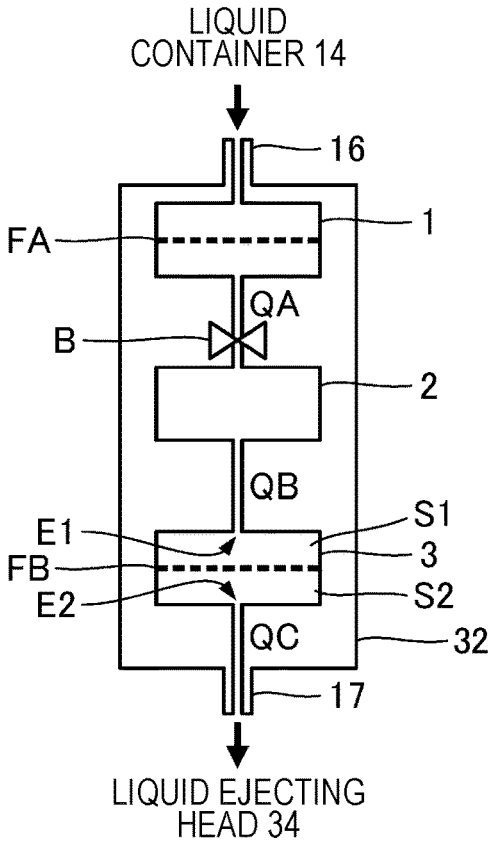
FIG. 3 is a schematic diagram of a flow path formed inside a flow path member according to an embodiment.

FIG. 3 is a schematic diagram of a flow path formed inside a flow path member according to an embodiment.

As illustrated in FIG. 3, the flow path member 32 has a plurality of flow paths QA, QB, and QC and a plurality of flow path chambers 1, 2, and 3 between the supply flow path 16 and the discharge flow path 17. Each flow path QA, QB, and QC is a path through which the ink flows, and each flow path chamber 1, 2, and 3 is a space communicated with each flow path QA, QB, and QC.

The flow path chamber 1 is a space disposed between the supply flow path 16 and the flow path QA and communicating with the supply flow path 16 and the flow path QA. A filter FA is installed in the flow path chamber 1. The filter FA collects foreign matter from the ink supplied to the flow path chamber 1 from the supply flow path 16.

The flow path chamber 2 is a space disposed between the flow path QA and the flow path QB and communicating with the flow path QA and the flow path QB. Furthermore, an adjustment mechanism B is installed between the flow path QA and the flow path chamber 2.

The adjustment mechanism B is a valve mechanism that controls opening and closing of the flow path QA according to the pressure (negative pressure) in the flow path chamber 2. Specifically, the adjustment mechanism B closes the flow path QA in a normal state where the pressure in the flow path chamber 2 is maintained within a predetermined range, and opens the flow path QA when the ink in the flow path chamber 2 is consumed and the negative pressure inside the flow path chamber 2 becomes strong. In a state where the adjustment mechanism B opens the flow path QA, the ink flowing into the flow path chamber 2 from the flow path QA is supplied to the flow path QB.

In addition, when foreign matter is mixed in the ink supplied from the flow path chamber 1 to the flow path QA, there is a possibility that the foreign matter inhibits the operation of the adjustment mechanism B, so that the ink from which foreign matter is removed by the filter FA is supplied from the flow path chamber 1 to the flow path QA.

A flow path chamber 3 is disposed between the flow path QB and the flow path QC and is a space communicated with the flow path QB and the flow path QC. The flow path chamber 3 has an entrance E1 into which the ink flows and an exit E2 through which the ink flows out. A filter FB is installed in the flow path chamber 3. The filter FB collects foreign matter from the ink supplied from the flow path QB to the flow path chamber 3.

Furthermore, the filter FB partitions the flow path chamber 3 into two spaces S1 and S2. In the flow path chamber 3, a space on the entrance E1 side with respect to the filter FB is a first space S1 and a space on the exit E2 side with respect to the filter FB is a second space S2.

With such a configuration, the ink in the flow path chamber 2 flows into the first space S1 of the flow path chamber 3 via the flow path QB and the entrance E1. After the foreign matter is collected by the filter FB, the ink flows into the second space S2 of the flow path chamber 3 and is discharged from the exit E2. The ink discharged from the exit E2 is supplied to the liquid ejecting head 34 from the discharge flow path 17 communicating with the flow path QC via the flow path QC.

The flow path chamber 3 among the flow path chambers 1, 2, and 3 of the flow path member 32, is disposed at the most downstream side in the flow direction of the ink, and most influences the operation of the liquid ejecting head 34.

For example, when the foreign matter is contained in the ink supplied from the flow path chamber 3 to the liquid ejecting head 34, there is a possibility that the liquid ejecting head 34 may not operate properly, so that the filter FB installed in the flow path chamber 3 is finer as compared with the filter FA installed in the flow path chamber 1 and is capable of collecting minute foreign matter.

For example, when bubbles are contained in the ink supplied from the flow path chamber 3 to the liquid ejecting head 34, there is a possibility that the liquid ejecting head 34 may not operate properly, so that the bubbles are less likely to be stayed in the flow path chamber 3, and the bubbles are likely to be discharged together with the ink from the exit E2 in the above-described maintenance process. That is, the flow path member 32 according to the embodiment has a good configuration in which the bubbles are likely to be discharged from the exit E2, and capable of enhancing the discharge performance of the bubbles in a case where the bubbles are contained in the ink. The details will be described below.

Figure 4A:
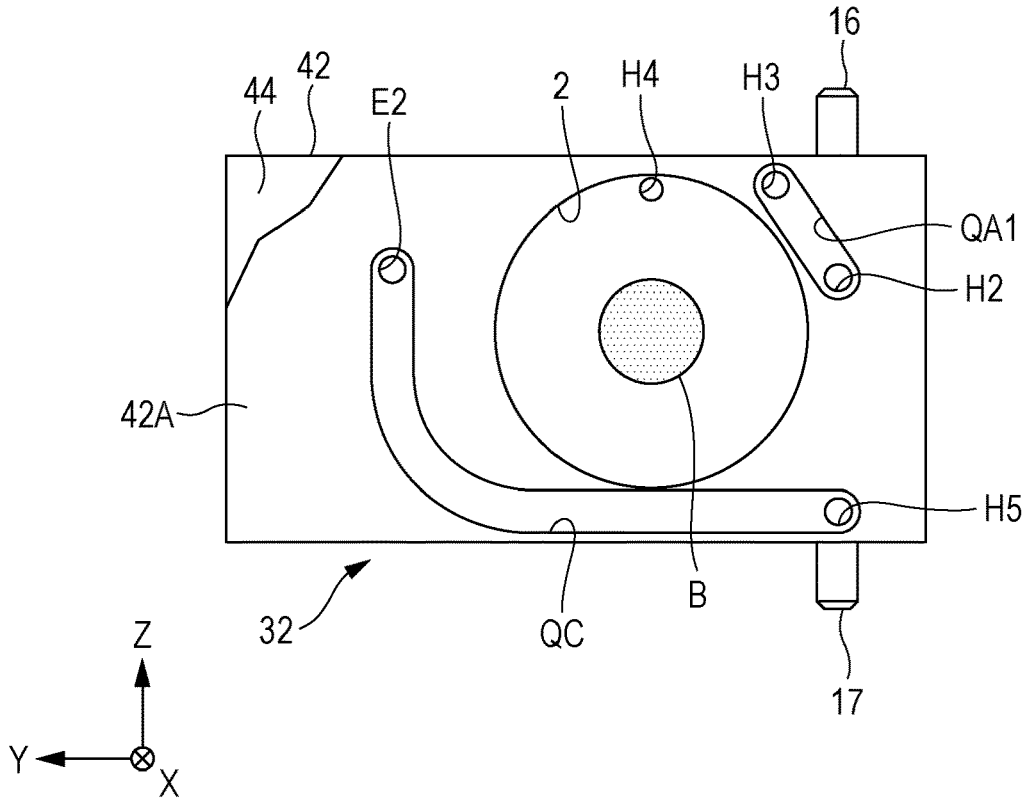
FIG. 4A is a configuration diagram of a flow path member according to Embodiment 1.
Figure 4B:
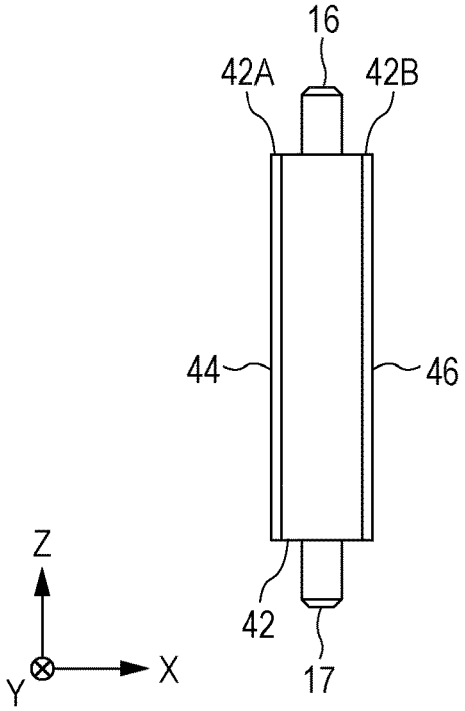
FIG. 4B is a configuration diagram of the flow path member according to Embodiment 1.
Figure 4C:
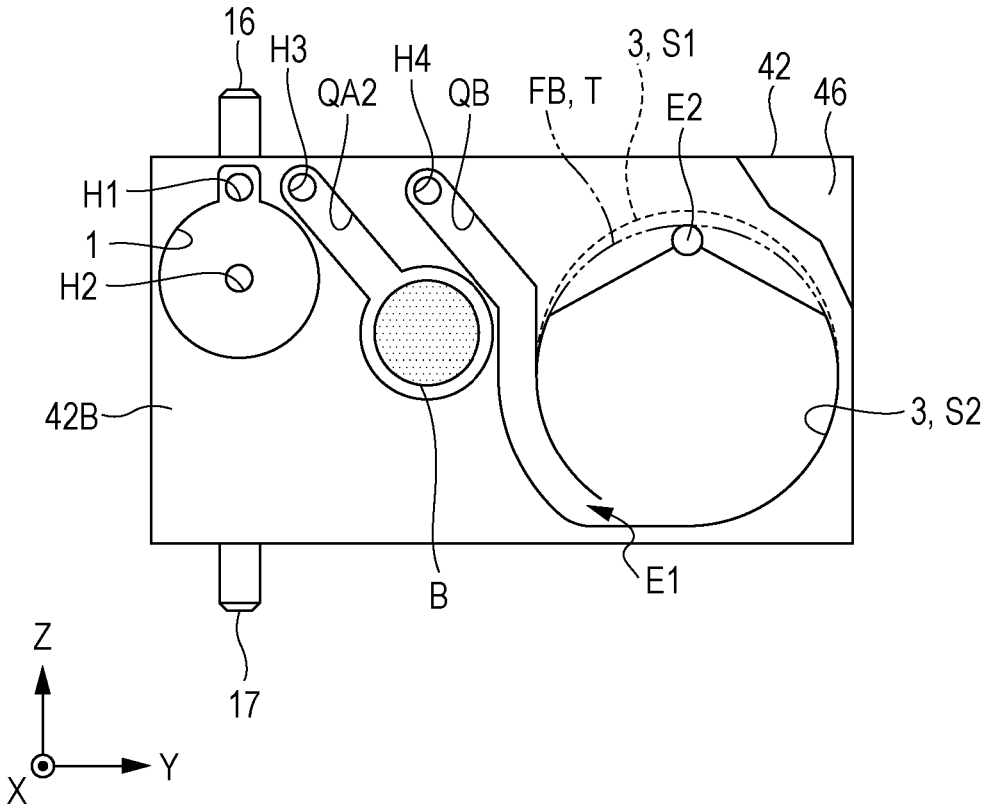
FIG. 4C is a configuration diagram of the flow path member according to Embodiment 1.
Figure 5:
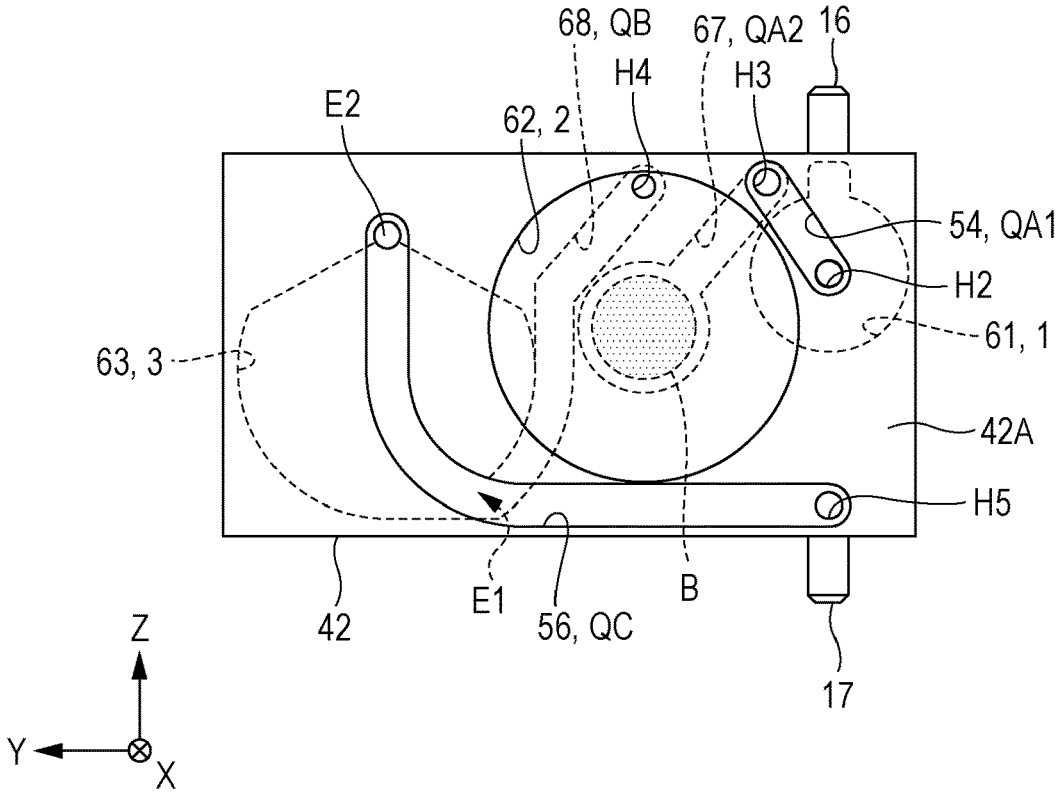
FIG. 5 is a plan view of a first surface of a base body.
Figure 6:
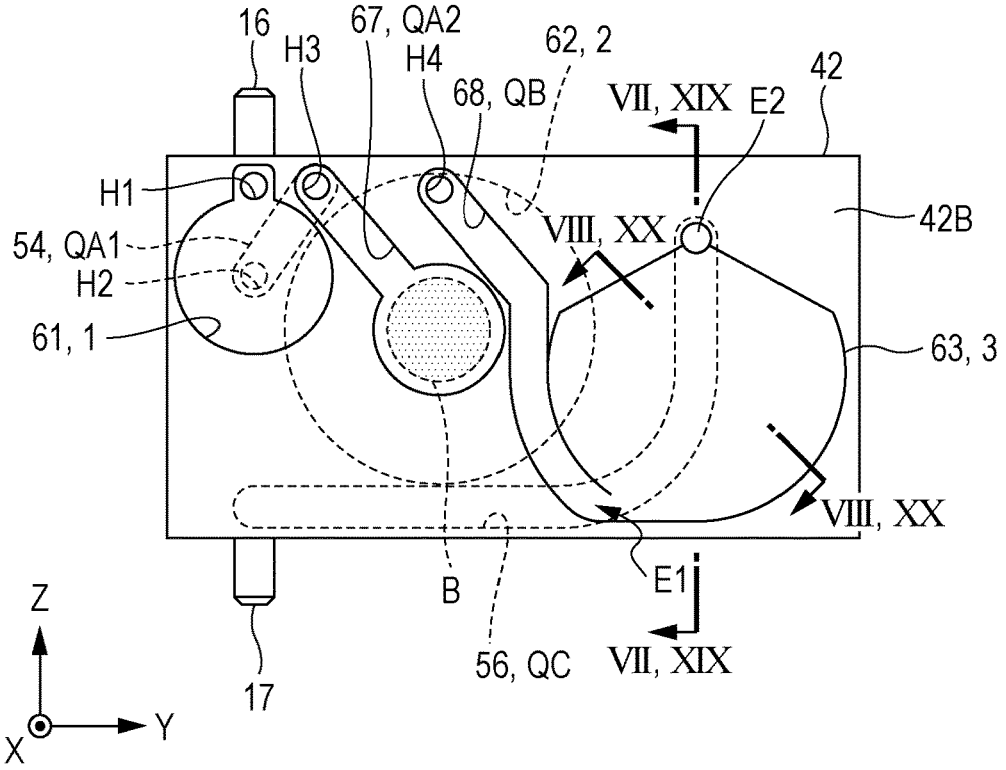
FIG. 6 is a plan view of a second surface of the base body.

FIGS. 4A, 4B, and 4C are configuration diagrams of a flow path member according to the embodiment. FIG. 5 is a plan view of a first surface of a base body. FIG. 6 is a plan view of a second surface of the base body.

FIG. 4A is a diagram of the flow path member 32 as viewed from the first surface 42A side. FIG. 4B is a diagram of the flow path member 32 as viewed from the third surface 42C side. FIG. 4C is a diagram of the flow path member 32 as seen from the second surface 42B side. Furthermore, in FIGS. 4A to 4C, in order to make the states of the surfaces 42A and 42B easy to understand, illustration of the sealing body 44 and the sealing body 46 is partially omitted. In addition, in FIGS. 5 and 6, an adjustment mechanism B is illustrated in addition to the surfaces 42A and 42B of the base body 42.

Furthermore, in FIG. 4C, a contour of the second space S2 in the flow path chamber 3 is indicated by a solid line, a contour of the first space S1 in the flow path chamber 3 is indicated by a dashed line, and an end T of the filter FB (refer to FIG. 8) provided with the fixing portion 6 (refer to FIG. 8) is indicated by a two-dot chain line. The dashed line in FIG. 4C is a part of the contour of the first space S1.

As illustrated in FIGS. 4A to 4C, the base body 42 is a substantially flat plate-like structure including the first surface 42A and the second surface 42B which are positioned on sides opposite to each other, and is formed by injection molding of a resin material, for example. In the embodiment, the base body 42 is formed of polypropylene (PP).

In addition to flexibility (elasticity), the sealing bodies 44 and 46 are members having barrier properties against moisture, oxygen and nitrogen. Specifically, the sealing bodies 44 and 46 have a three-layer structure in which a polypropylene film layer having flexibility (elasticity), a barrier layer formed of silica ($SiO^2$), and a reinforcing layer formed of polyethylene terephthalate are laminated. The sealing body 44 is joined to the first surface 42A of the base body 42 and the sealing body 46 is joined to the second surface 42B of the base body 42.

As illustrated in FIG. 5, a recessed portion 62, a groove portion 54, and a groove portion 56 are formed on the first surface 42A of the base body 42. The recessed portion 62, the groove portion 54, and the groove portion 56 are low recessed portions on the first surface 42A, and are sealed (tight sealed) by the sealing body 44 joined to the first surface 42A. The recessed portion 62 is formed in a substantially circular shape in plan view as viewed from the X axial direction.

A space surrounded by the recessed portion 62 and the sealing body 44 functions as the flow path chamber 2. A space surrounded by the groove portion 56 and the sealing body 44 functions as the flow path QC. A space surrounded by the groove portion 54 and the sealing body 44 functions as a portion QA1 of the flow path QA.

As illustrated in FIG. 6, a recessed portion 61, a recessed portion 63, a groove portion 67, and a groove portion 68 are formed on the second surface 42B of the base body 42. The recessed portion 61, the recessed portion 63, the groove portion 67, and the groove portion 68 are low recessed portions on the second surface 42B, and are sealed (tight sealed) by a sealing body 46 joined to the second surface 42B.

A space surrounded by the recessed portion 61 and the sealing body 46 functions as the flow path chamber 1. A space surrounded by the recessed portion 63 and the sealing body 46 functions as the flow path chamber 3. A space surrounded by the groove portion 67 and the sealing body 46 functions as a portion QA2 of the flow path QA. A space surrounded by the groove portion 68 and the sealing body 46 functions as the flow path QB.

As illustrated in FIGS. 5 and 6, the supply flow path 16 communicates with the flow path chamber 1 on the second surface 42B side via a communication hole H1 penetrating the base body 42. The flow path chamber 1 on the second surface 42B side communicates with an end portion on the upstream side of the portion QA1 of the flow path QA on the first surface 42A side via a communication hole H2 penetrating the base body 42. An end portion on the downstream side of the portion QA1 of the flow path QA on the first surface 42A side communicates with an end portion on the upstream side of the portion QA2 of the flow path QA on the second surface 42B side via a communication hole H3 penetrating the base body 42. Furthermore, an end portion on the downstream side of the portion QA2 of the flow path QA on the second surface 42B side communicates with the flow path chamber 2 on the first surface 42A side via the adjustment mechanism B. The flow path chamber 2 on the first surface 42A side communicates with the end portion on the upstream side of the flow path QB on the second surface 42B side via a communication hole H4 penetrating the base body 42. An end portion on the downstream side of the flow path QB on the second surface 42B side communicates with the flow path chamber 3 on the second surface 42B side via the entrance E1. The entrance E1 is an opening provided in a partition wall that partitions the flow path QB and the flow path chamber 3. The flow path chamber 3 on the second surface 42B side communicates with the end portion on the upstream side of the flow path QC on the first surface 42A side via the exit E2. The exit E2 is a hole penetrating the base body 42. An end portion on the downstream side of the flow path QC on the first surface 42A side communicates with the discharge flow path 17 via a communication hole H5.

In this manner, in the flow path member 32, the flow path in which the ink flows is formed by the supply flow path 16, the communication hole H1, the flow path chamber 1 on the second surface 42B side, the communication hole H2, the portion QA1 of the flow path QA on the first surface 42A side, the communication hole H3, the flow path QA on the second surface 42B side, the adjustment mechanism B, the flow path chamber 2 on the first surface 42A side, the communication hole H4, the flow path QB on the second surface 42B side, the entrance E1, the flow path chamber 3 on the second surface 42B side, the exit E2, the flow path QC on the first surface 42A side, the communication hole H5, and the discharge flow path 17.

The ink supplied from the liquid container 14 is supplied to the liquid ejecting head 34 via the flow path of the flow path member 32 and a supply pipe 38.

Figure 7:
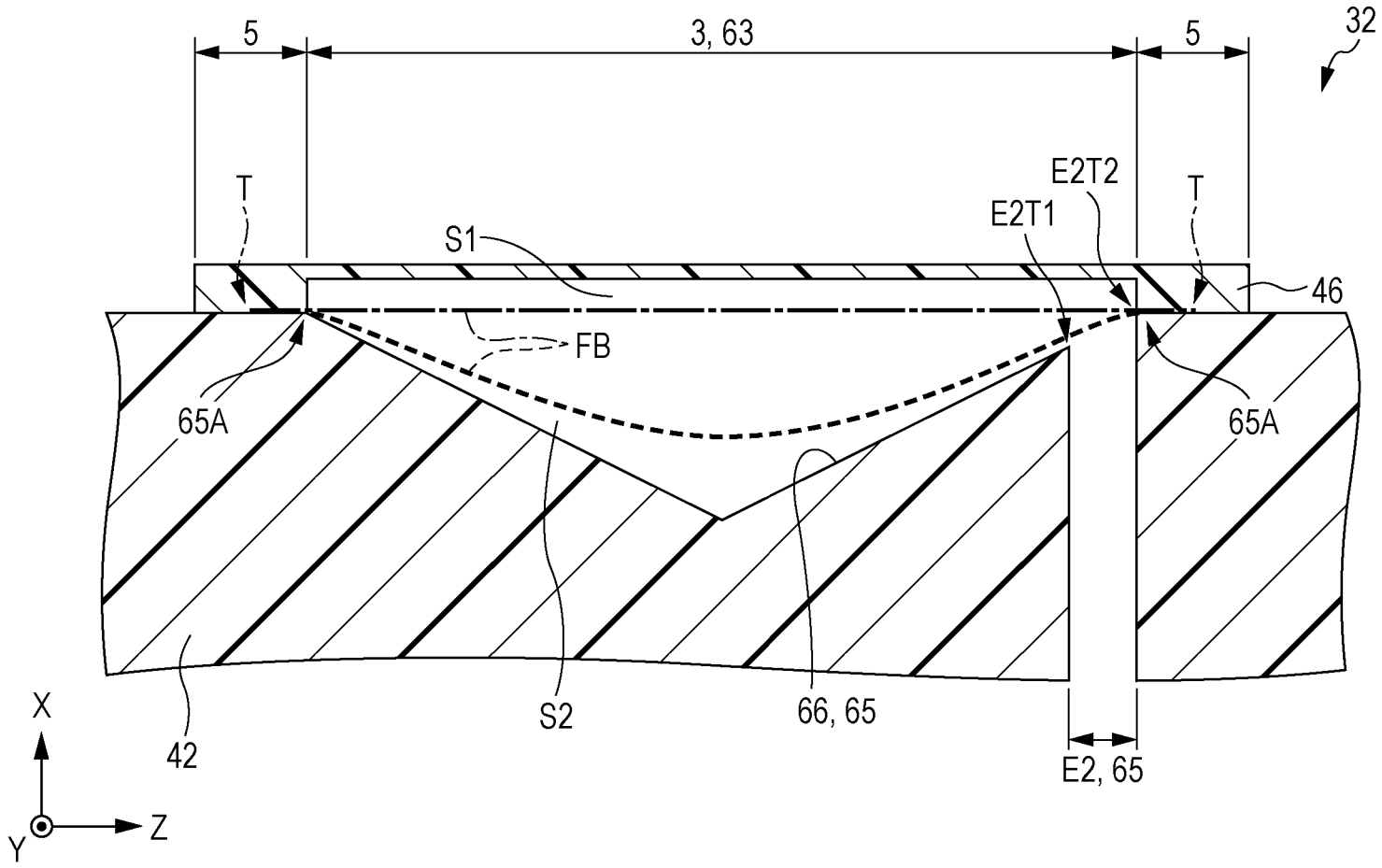
FIG. 7 is a cross-sectional view of the flow path member according to Embodiment 1 taken along line VII-VII in FIG. 6.
Figure 8:
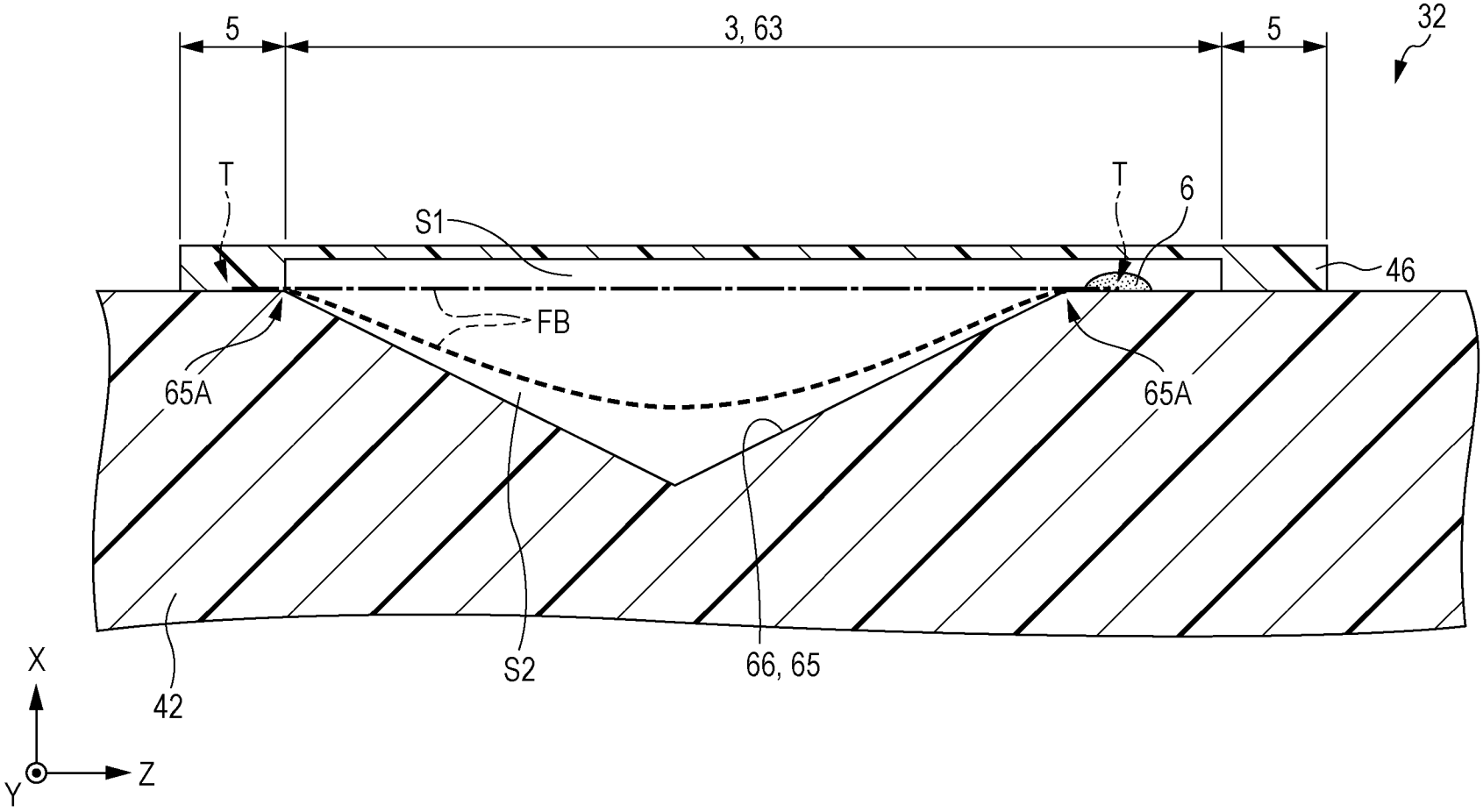
FIG. 8 is a cross-sectional view of the flow path member according to Embodiment 1 taken along line VIII-VIII in FIG. 6.
Figure 9:
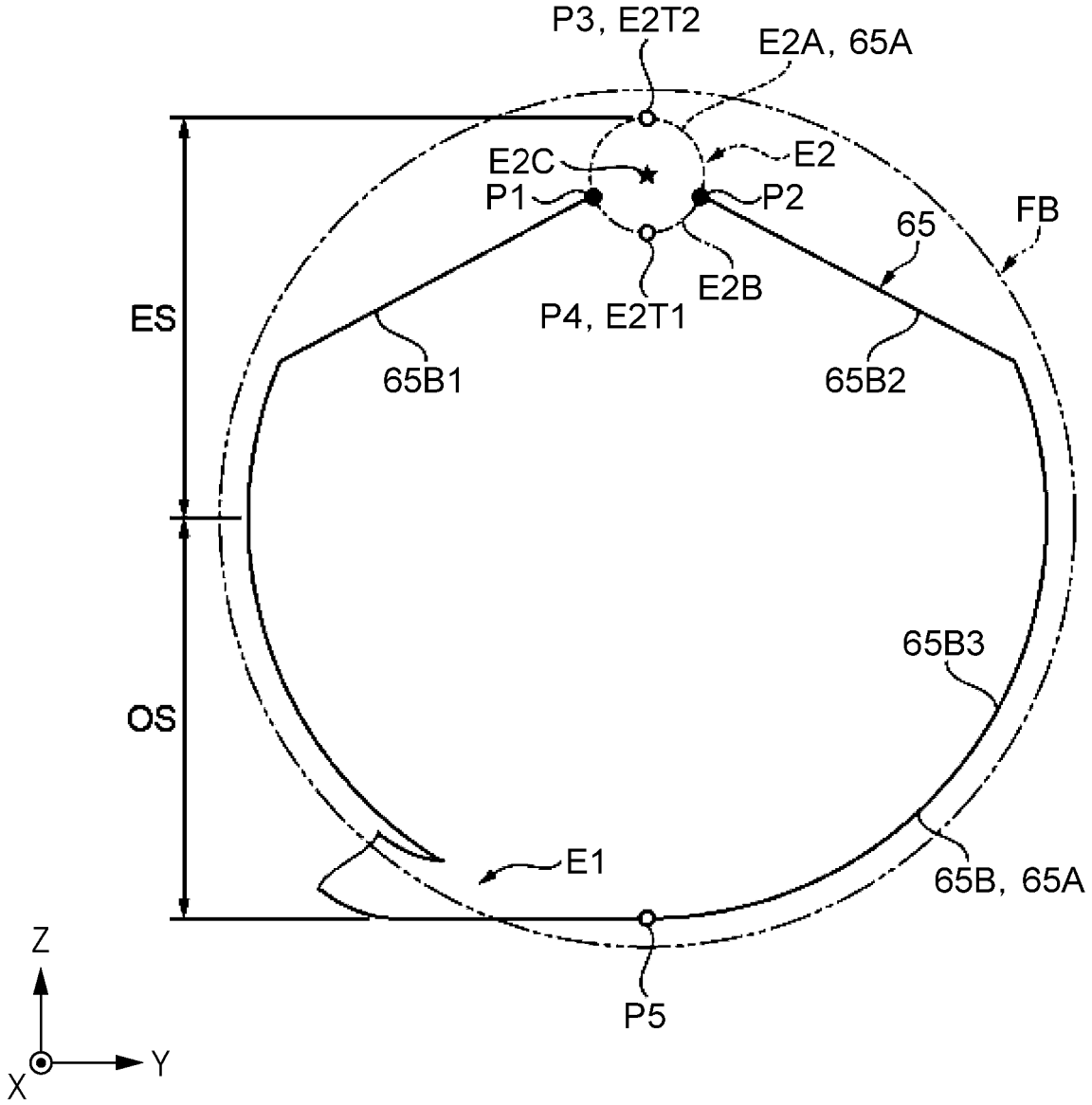
FIG. 9 is a plan view of a flow path chamber viewed in an X axial direction.

FIG. 7 is a cross-sectional view of the flow path member according to the embodiment taken along line VII-VII in FIG. 6. FIG. 8 is a cross-sectional view of the flow path member according to the embodiment taken along line VIII-VIII in FIG. 6. FIG. 9 is a plan view of a flow path chamber 3 viewed in an X axial direction, and is a schematic diagram illustrating a state of a contour 65A of a bottom surface 65 of the recessed portion 63 forming the flow path chamber 3.

In FIGS. 7 and 8, the filter FB in a case where the ink is not flowing is indicated by a one-dot chain line, and the filter FB in a case where the ink flows is indicated by a dashed line. Furthermore, in FIG. 9, the contour 65A of the bottom surface 65 is illustrated by a solid line or a dashed line, the contours E2A and E2B of the exit E2 formed on the bottom surface 65 are illustrated by a dashed line or an one-dot chain line, and the filter FB is illustrated by a two-dot chain line.

As illustrated in FIG. 7, the flow path chamber 3 is a space where the recessed portion 63 is sealed by the sealing body 46, and the filter FB is installed inside thereof. In the flow path chamber 3, a space partitioned by the sealing body 46 and the filter FB is a first space S1, and a space partitioned by the filter FB and the bottom surface 65 of the recessed portion 63 is a second space S2. The first space S1 is disposed on the side in the +X axial direction with respect to the filter FB, and the second space S2 is disposed on the side in the −X axial direction with respect to the filter FB.

In addition, the bottom surface 65 of the recessed portion 63 is a surface facing the filter FB. The end of the space (flow path chamber 3) where the bottom surface 65 (recessed portion 63) is sealed by the sealing body 46 becomes the contour 65A of the bottom surface 65. That is, the contour 65A of the bottom surface 65 corresponds to a portion where the bottom surface 65 and the sealing body 46 are in contact with each other.

The entrance E1 (refer to FIG. 6) into which ink flows is provided in the first space S1. The second space S2 is separated from the first space S1 by the filter FB and has the exit E2 through which the ink flows out and the bottom surface 65 facing the filter FB.

In a case where the ink does not flow in the flow path chamber 3, the filter FB is disposed along the Z axial direction as indicated by a one-dot chain line in the drawing. The XY plane is a horizontal plane, the Z axial direction is an example of "direction intersecting the horizontal plane", and the filter FB is disposed along the direction intersecting the XY plane (horizontal plane). In the embodiment, the angle formed by the filter FB and the XY plane (horizontal plane) is 90°. The angle formed by the filter FB and the XY plane (horizontal plane) is not limited to 90°, and may be smaller than 90° or larger than 90°.

The bottom surface 65 of the recessed portion 63 is inclined so as to intersect with the Z axial direction. Specifically, the bottom surface 65 of the recessed portion 63 is spaced away from the filter FB from the end of the filter FB toward the center in a case where the filter FB is viewed in plan view. In other words, the bottom surface 65 of the recessed portion 63 includes an inclined surface 66 spaced away from the filter FB toward the center from the end of the filter FB in a case where the filter FB is viewed in plan view.

In the following description, the bottom surface 65 of the recessed portion 63 may be simply referred to as the inclined surface 66. The inclined surface 66 is a surface that intersects with the Z axial direction on the bottom surface 65.

In a case where the ink flows in the flow path chamber 3, that is, in a case where ink flows from the first space S1 to the second space S2, the filter FB deflects in the direction from the first space S1 toward the second space S2, that is, in the flow direction of the ink due to the pressure of the flowing ink. Specifically, the filter FB is displaced so that the center of the filter FB approaches the inclined surface 66, as indicated by the dashed line in the drawing. As a result, in a case where the ink flows in the flow path chamber 3, the distance between the filter FB and the inclined surface 66 becomes shorter as compared with a case where the ink does not flow in the flow path chamber 3, the cross sectional area of the first space S1 increases, and the cross sectional area of the second space S2 decreases.

The cross sectional area of the spaces S1 and S2 is the area of the surface along the XY plane of the spaces S1 and S2.

In a case where the ink flows from the first space S1 toward the second space S2 and the filter FB deflects from the first space S1 toward the second space S2 due to the pressure of the flowing ink, the inclined surface 66 is provided so as not to be in contact with the filter FB. In other words, in a case where the ink flows from the first space S1 toward the second space S2 and the filter FB deflects from the first space S1 toward the second space S2, the inclined surface 66 is disposed along a deflection of the filter FB from the first space S1 toward the second space S2.

When bubbles are contained in the ink flowing from the first space S1 to the second space S2, the filter FB deflects from the first space S1 toward the second space S2 due to the pressure of the flowing ink, and the filter FB comes into contact with the inclined surface 66, the bubbles are confined (constrained) at a portion where the filter FB and the inclined surface 66 are in contact with each other, and the bubbles are less likely to be discharged from the flow path chamber 3. In the embodiment, even in a case where the filter FB deflects from the first space S1 toward the second space S2 due to the pressure of the flowing ink, the inclined surface 66 is provided so as not to be in contact with the filter FB, so that the bubbles are confined (constrained) at the portion where the filter FB and the inclined surface 66 are in contact with each other, and it is possible to suppress a problem that the bubbles are less likely to be discharged from the flow path chamber 3.

In the embodiment, in the case where the ink flows in the flow path chamber 3, the cross sectional area of the second space S2 is smaller as compared with the case where the ink does not flow in the flow path chamber 3, so that the flow (flow velocity) of the ink flowing in the second space S2 becomes faster than in the case where the cross sectional area of the second space S2 is large. When the flow of the ink flowing in the second space S2 becomes faster, the ink flowing into the second space S2 is likely to be quickly discharged from the exit E2 without staying in the second space S2 as compared with the case where the flow of ink flowing in the second space S2 is slow. That is, when the cross sectional area of the second space S2 becomes small and the flow of ink flowing in the second space S2 becomes fast, the ink is likely to be discharged from the exit E2, and in a case where the bubbles are contained in the ink, the bubbles are likely to be discharged from the exit E2, and the discharge performance of the bubbles can be enhanced.

As the filter FB, for example, a fiber formed of a stainless steel obtained by twill weaving is used. Besides, as the filter FB, a nonwoven fabric or the like can be used. The filter FB is larger than the bottom surface 65 (recessed portion 63), and the end T protrudes from the bottom surface 65 (recessed portion 63) in plan view (refer to FIG. 9).

The sealing body 46 is fixed (joined) to the base body 42 by thermal welding. Specifically, the sealing body 46 and the base body 42 are thermally welded by irradiation with a heat tool or laser light or the like, and the sealing body 46 is fixed (joined) to the base body 42. A portion where the sealing body 46 and the base body 42 are thermally welded is a joining portion 5. The joining portion 5 is formed on a peripheral edge of the flow path chamber 3 (recessed portion 63).

The end T of the filter FB is disposed at the joining portion 5 where the sealing body 46 and the base body 42 are thermally welded. That is, in a state where the end T of the filter FB is disposed between the sealing body 46 and the base body 42, the sealing body 46 and the base body 42 are thermally welded, the end T of the filter FB is disposed at the joining portion 5, and the end T of the filter FB is fixed to the base body 42. In this manner, in addition to fixing the sealing body 46 to the base body 42, the filter FB is fixed to the base body 42 by thermally welding the sealing body 46 and the base body 42.

It is not limited to forming the joining portion 5 by thermally welding the sealing body 46 and the base body 42, and an adhesive may be disposed between the sealing body 46 and the base body 42 and the adhesive may be cured to form the joining portion 5. An 0 ring may be disposed between the sealing body 46 and the base body 42 and a portion where the 0 ring is disposed may be pressed by a pressing member to form the joining portion 5.

Since the end T of the filter FB is disposed in a portion (joining portion 5) where the sealing body 46 and the base body 42 are thermally welded, the fibers formed of stainless steel constituting the filter FB are less likely to be released at the end T.

When the fibers formed of stainless steel constituting the filter FB are released at the end T, the released portion of the fiber formed of stainless steel separates from the end T to become a new foreign matter and there is a possibility that the new foreign matter is discharged from the exit E2. Furthermore, there is a possibility that the released portion of the fiber formed of stainless steel damages the sealing bodies 44 and 46, and a hole (scratch) occurs in the sealing bodies 44 and 46. When the end T of the filter FB is disposed at the joining portion 5, since the fibers formed of stainless steel constituting the filter FB are less likely to be released at the end T, such a problem can be suppressed.

As illustrated in FIG. 8, the filter FB has a portion where the end T is disposed between the joining portion 5 and the bottom surface 65, except for the portion where the end T is disposed in the joining portion 5. In the embodiment, the fixing portion 6 fixed to the end T of the filter FB disposed between the joining portion 5 and the bottom surface 65 is provided. That is, as illustrated by the two-dot chain line in FIG. 4C, the fixing portion 6 is provided at the end T of the filter FB positioned outside the second space S2 and the exit E2 (that is, outside the outer shape of the bottom surface 65).

In other words, in a case where the filter FB is viewed in plan view, the fixing portion 6 fixed to the end T of the filter FB is provided outside the outer shape of the bottom surface 65. For example, the fixing portion 6 is formed by applying the end T of the filter FB with an adhesive and curing the adhesive. When the adhesive has adhesiveness to the base body 42, the end T of the filter FB can be fixed to the base body 42.

When the fixing portion 6 fixed to the end T of the filter FB is provided, the fibers formed of stainless steel constituting the filter FB are less likely to be released at the end T, and it is possible to suppress the problem caused by releasing fibers formed of stainless steel constituting the filter FB at the end T.

As illustrated in FIGS. 7 and 9, in the flow path chamber 3 (bottom surface 65), the exit E2 is disposed at the end of the bottom surface 65 and further extends in the +Z axial direction. In other words, in the flow path chamber 3 (bottom surface 65), the exit E2 is positioned at the uppermost side in the gravity direction.

In a case where the bubbles are contained in the ink flowing into the flow path chamber 3, the bubbles float upward in the gravity direction due to buoyancy. Therefore, when the exit E2 is formed at the uppermost side in the gravity direction of the flow path chamber 3 (bottom surface 65), the bubbles floating upward in the gravity direction due to the buoyancy are likely to be discharged from the exit E2.

Therefore, when the exit E2 is formed at the uppermost side in the gravity direction of the flow path chamber 3 (bottom surface 65), the discharge performance of the bubbles can be enhanced.

Furthermore, the exit E2 is (is provided) in the middle of the inclined surface 66. In the exit E2, one end E2T1 of the exit E2 in the Z axial direction is disposed on the side in the −Z axial direction, the other end E2T2 of the exit E2 in the Z axial direction is disposed on the side in the +Z axial direction, and the position of the end E2T1 of the exit E2 in the X axial direction is different from the position of the end E2T2 of the exit E2 in the X axial direction.

"In the middle of the inclined surface" in the application means a state where the position of the end E2T1 of the exit E2 in the X axial direction is different from the position of the end E2T2 of the exit E2 in the X axial direction. In other words, "in the middle of the inclined surface" in the application means a state where the distance between the end E2T1 of the exit E2 and the filter FB and the distance between the end E2T2 of the exit E2 and the filter FB are different from each other.

In this manner, the flow path member 32 according to the embodiment is provided with the filter FB, the first space S1 provided with the entrance E1 into which the ink flows, the exit E2 separated from the first space S1 by the filter FB and through which the ink flows out, and the second space S2 having the bottom surface 65 facing the filter FB. The bottom surface 65 includes the inclined surface 66 spaced away from the filter FB toward the center from the end of the filter FB in a case where the filter FB is viewed in plan view, and the exit E2 is in the middle of the inclined surface 66.

In other words, the flow path member 32 according to the embodiment has the filter FB, the first space S1 provided with the entrance E1 into which the ink flows, the second space S2 separated from the first space S1 by the filter FB and has the bottom surface 65 facing the filter FB, and the exit E2 provided on the bottom surface 65 and through which the ink flows out.

The contour E2A of the exit E2 indicated by the dashed line in FIG. 9 forms a portion of the contour 65A of the bottom surface 65 and is an example of a "first contour". The contour 65B of the bottom surface 65 indicated by the solid line in FIG. 9 forms a portion of the contour 65A of the bottom surface 65 and is an example of a "second contour". The contour E2B of the exit E2 indicated by the one-dot chain line in FIG. 9 is not included in the contour 65A of the bottom surface 65.

Portions P1 and P2 indicated by black circles in FIG. 9 are portions where the contour 65B of the bottom surface 65 and the contour E2A of the exit E2 intersect with each other, form a portion of the contour 65A of the bottom surface 65, and are examples of "intersection point". A portion P3 indicated by a white circle in FIG. 9 is a portion of the contour E2A of the exit E2 farthest from the portions P1 and P2, and is an example of "portion of the first contour farthest from the intersection point".

A portion E2C indicated by a black star in FIG. 9 is the center of the exit E2 and is hereinafter referred to as the center E2C. A portion P4 indicated by a white circle in FIG. 9 is a portion of the contour E2B of the exit E2 farthest from the portions P1 and P2. A portion P5 indicated by a white circle in FIG. 9 is a portion of the contour 65B of the bottom surface 65 of the recessed portion 63 farthest from the portions P1 and P2, and is an example of "portion of the second contour farthest from the intersection point".

The portion P3 corresponds to the other end E2T2 of the exit E2 in the Z axial direction and the portion P4 corresponds to one end E2T1 of the exit E2 in the Z axial direction. Furthermore, the direction from the portion P5 toward the portion P3 is the +Z axial direction and is an example of a "first direction".

Furthermore, on the bottom surface 65, a region on the side in the +Z axial direction (side close to the exit E2) with respect to the middle between the portion P3 and the portion P5 is an example of an "exit side" and is hereinafter referred to as an exit side ES. On the bottom surface 65, a region on the side in the −Z axial direction (side far from the exit E2) with respect to the middle between the portion P3 and the portion P5 is an example of an "opposite side" and is hereinafter referred to as an opposite side OS.

As illustrated in FIG. 9, the contour 65A of the bottom surface 65 has the contour E2A which is the contour of the exit E2, the contour 65B which is different from the contour E2A of the exit E2, and portions P1 and P2 where the contour E2A and the contour 65B intersect with each other. The contour of the exit E2 is configured to include the contour E2A which forms the contour 65A of the bottom surface 65 and the contour E2B.

Furthermore, in a case where the filter FB is viewed in plan view, the width of the bottom surface 65 (dimension of the bottom surface 65 in the Y axial direction) gradually decreases with respect to the exit side ES than the side opposite thereto OS.

In a case where the filter FB is viewed in plan view, the state where the width of the bottom surface 65 gradually decreases with respect to the exit side ES corresponds to a shape in which the contour 65B of the bottom surface 65 narrows in the direction toward the exit E2 (+Z axial direction) at the exit side ES. Furthermore, in a case where the contour 65B of the bottom surface 65 narrows in a predetermined direction (+Z axial direction and −Z axial direction), the state where the width of the bottom surface 65 gradually decreases with respect to the exit side ES than the side opposite thereto OS corresponds to a state where the contour 65B of the bottom surface 65 on the exit side ES rapidly decreases than the opposite side OS.

That is, the contour 65B on the exit side ES rapidly narrows in the direction toward the exit E2 (+Z axial direction) as compared with the contour 65B on the opposite side OS. In other words, the contour 65B narrows at the exit side ES when the contour 65B approaches the exit E2, and increases when the contour 65B is away from the exit E2. Furthermore, in other words, the contour 65B is provided so as to radially extend from the exit E2 as a starting point.

The contour E2A is positioned on the side in the +Z axial direction with respect to the portions P1 and P2. The contour 65B is positioned on the side in the −Z axial direction with respect to the portions P1 and P2. The contour E2B is positioned on the side in the −Z axial direction with respect to the portions P1 and P2. The portions P1 and P2 are positioned on the side in the −Z axial direction with respect to the center E2C of the exit E2.

Furthermore, the contour 65B positioned on the side in the −Z axial direction with respect to the portions P1 and P2 has a linear portion 65B1 linearly extending from the portion P1 in the −Y axial direction, a linear portion 65B2 linearly extending from the portion P2 in the +Y axial direction, and an arc-shaped curved portion 65B3 connecting the linear portion 65B1 and the linear portion 65B2 to each other. The linear portions 65B1 and 65B2 are provided so as to radially extend from the portions P1 and P2 of the exit E2 as starting points. The curved portion 65B3 connecting the linear portion 65B1 and the linear portion 65B2 to each other is disposed on the side in the −Z axial direction with respect to the portions P1 and P2, has an arc shape (circular shape), and is rounded.

In this manner, in a case where the direction from the portion P5 of the contour 65B farthest from the portions P1 and P2 toward the portion P3 of the contour E2A farthest from the portions P1 and P2 is set as a first direction (+Z axial direction), the flow path member 32 according to the embodiment has a configuration in which the contour E2A is positioned on the side in the first direction (side in +Z axial direction) with respect to the portions P1 and P2.

Furthermore, the flow path member 32 according to the embodiment has a configuration in which the portions P1 and P2 are positioned on the side opposite to the first direction (side in −Z axial direction) with respect to the center E2C of the exit E2.

In a case where the filter FB is viewed in plan view, the filter FB is larger than the bottom surface 65 and protrudes from the bottom surface 65. The area of the region where the filter FB and the bottom surface 65 overlap in plan view is an execution filtration area of the filter FB through which the ink is filtered by the filter FB.

When the execution filtration area of the filter FB decreases, the pressure loss of a case where the ink is filtered by the filter FB increases, the ink is less likely to flow in the flow path between the filter FB and the nozzle N, and the ink is less likely to be properly ejected from the nozzle N. When the execution filtration area of the filter FB increases, the pressure loss of a case where the ink is filtered by the filter FB decreases, the ink is likely to flow in the flow path between the filter FB and the nozzle N, and the ink is likely to be properly ejected from the nozzle N. Therefore, it is preferable that the execution filtration area of the filter FB is wide.

In the embodiment, in order to widen the execution filtration area of the filter FB, the execution filtration area of the filter FB on the opposite side OS is wider than the execution filtration area of the filter FB on the exit side ES. Since the execution filtration area of the filter FB is the area of the bottom surface 65, the area of the bottom surface 65 on the opposite side OS is wider than that on the exit side ES.

As described above, the curved portion 65B3 connecting the linear portion 65B1 and the linear portion 65B2 to each other is disposed on the side in the −Z axial direction with respect to the portions P1 and P2, has the arc shape (circular shape), and is rounded. In a case where the area where the bottom surface 65 is disposed is the same, when the curved portion 65B3 is formed in the circular shape, the area of the bottom surface 65 (execution filtration area of filter FB) can be widened, for example, as compared with a case where the curved portion 65B3 is formed in an elliptical shape.

Figure 10:
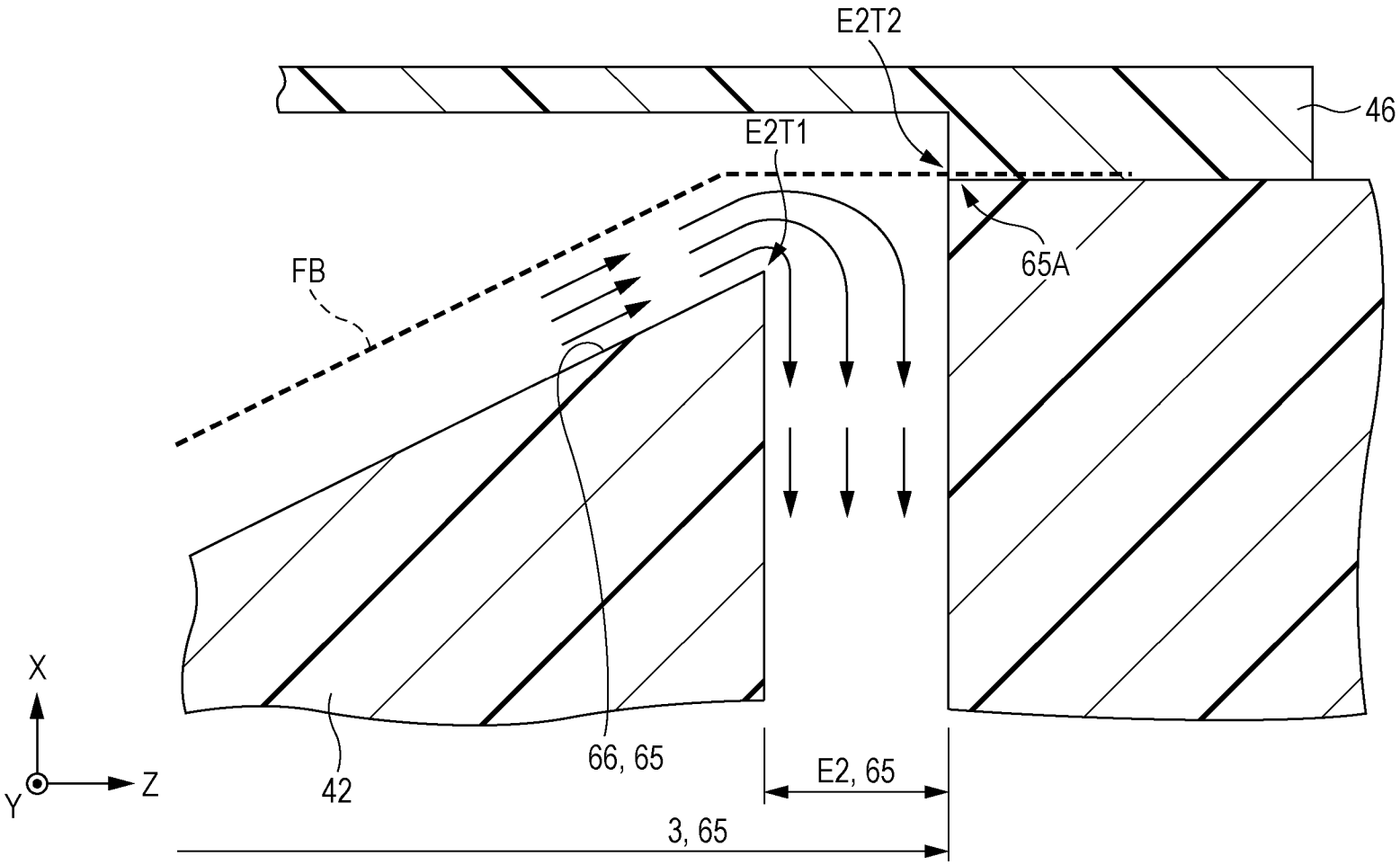
FIG. 10 is an enlarged cross-sectional view of a vicinity of an exit in FIG. 7.
Figure 11:
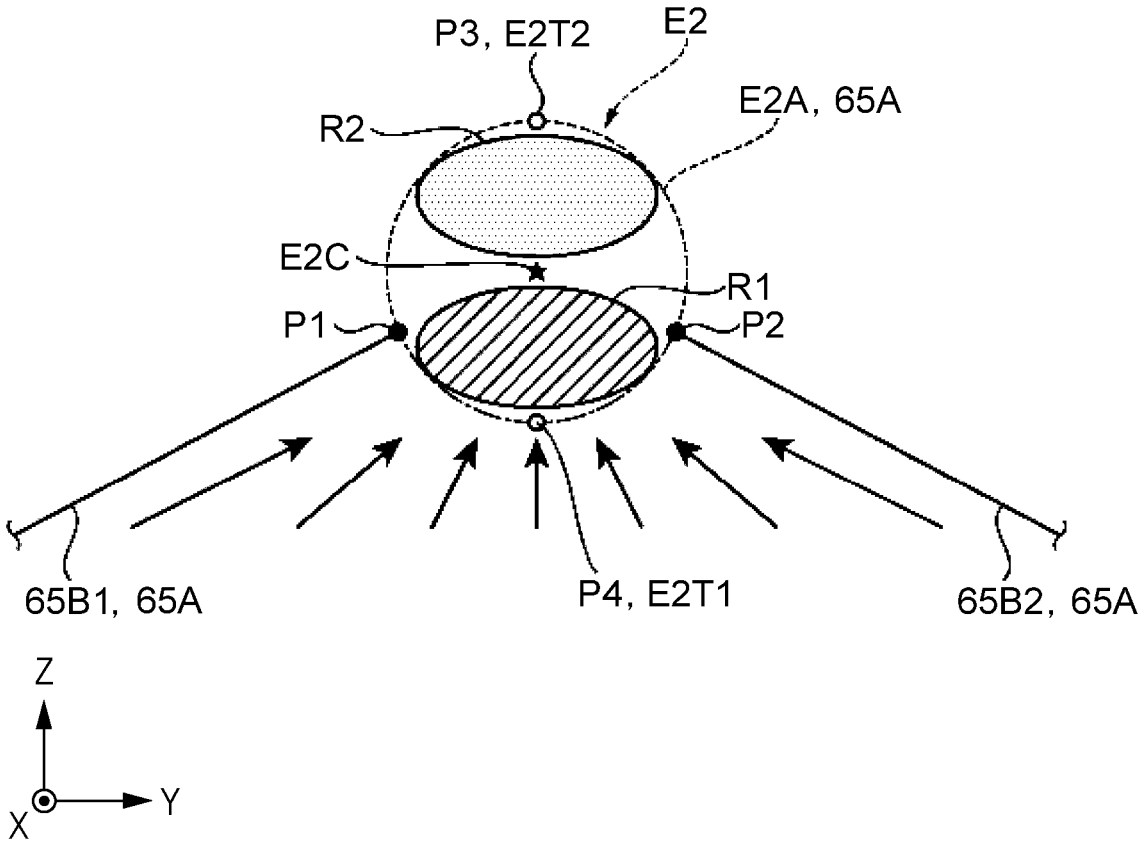
FIG. 11 is an enlarged plan view of a vicinity of an exit in FIG. 9.
Figure 12:
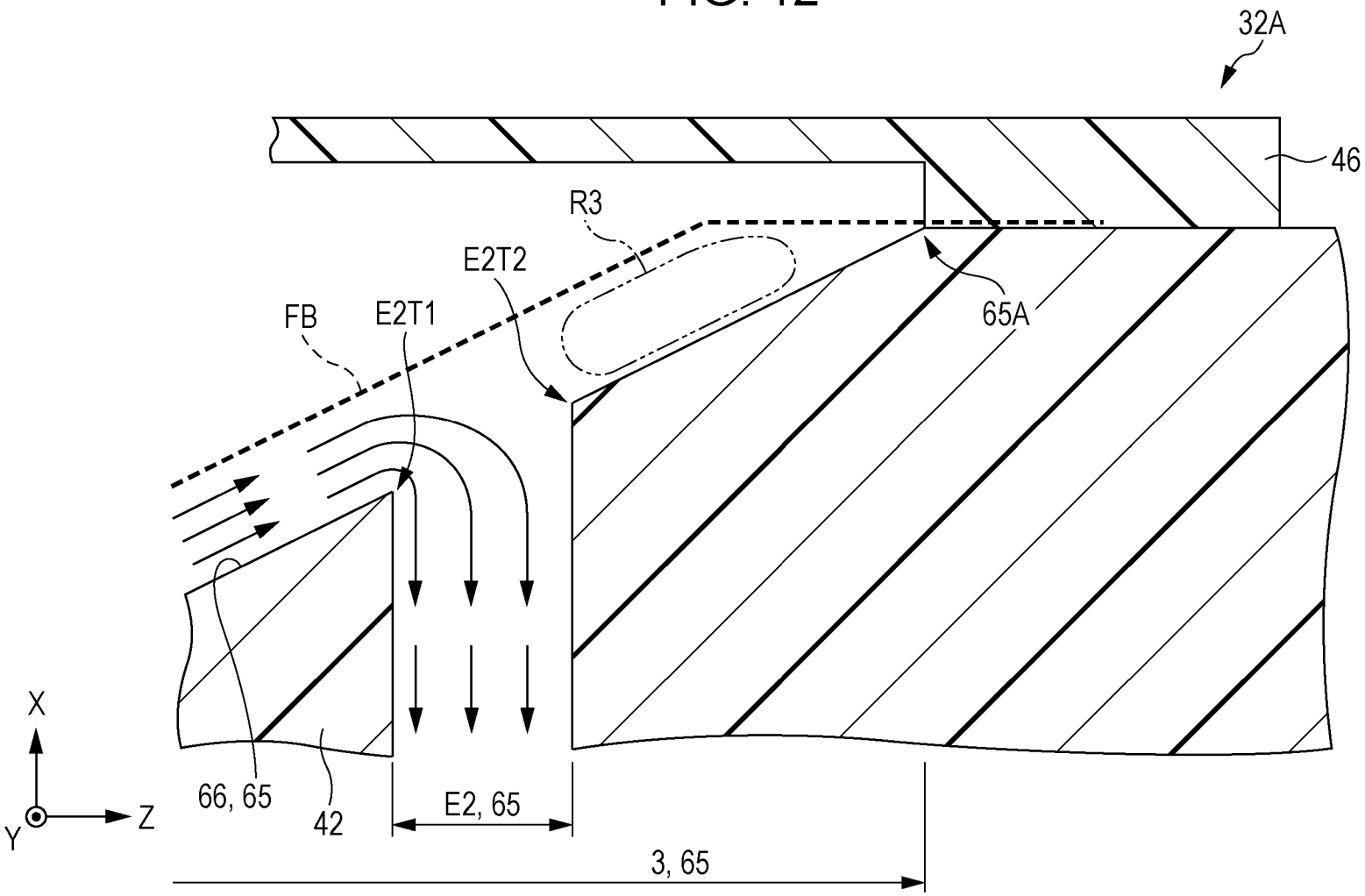
FIG. 12 is an enlarged cross-sectional view of a vicinity of an exit of a flow path member according to Modification Example 1.
Figure 13:
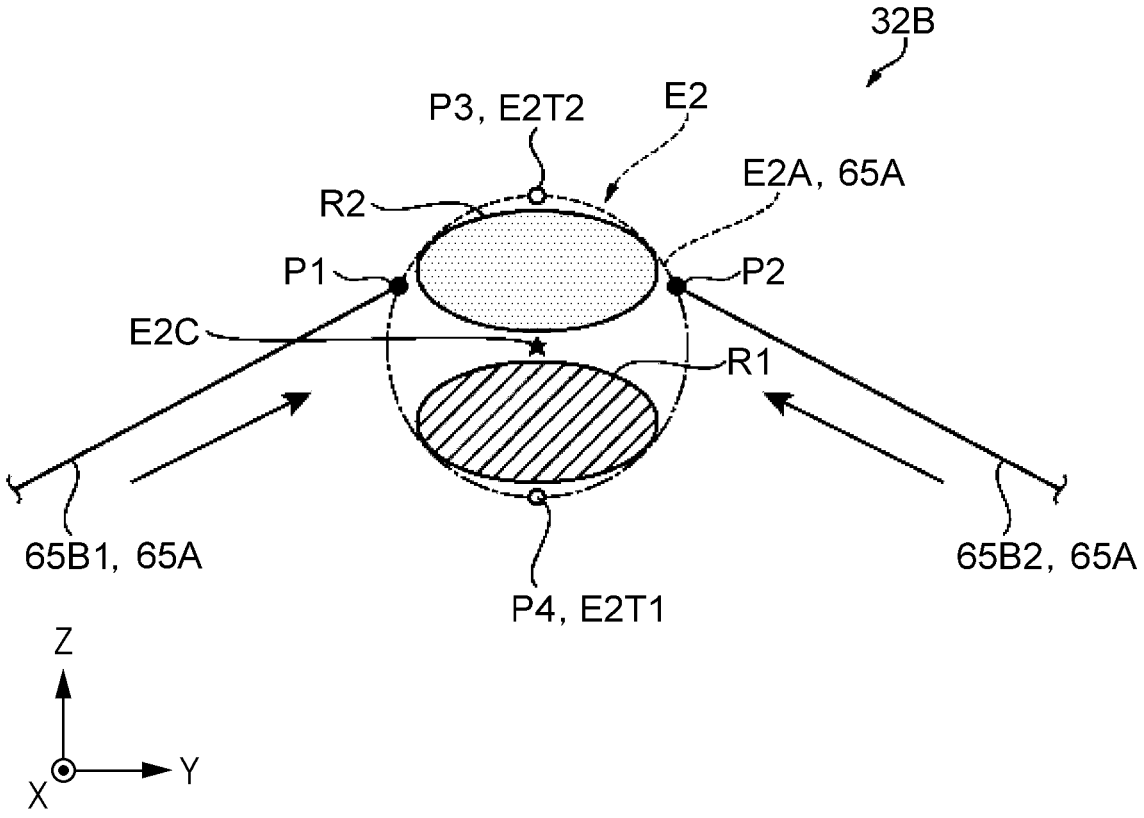
FIG. 13 is an enlarged plan view of a vicinity of an exit of a flow path member according to Modification Example 2.

FIG. 10 is an enlarged cross-sectional view of a vicinity of an exit in FIG. 7, and illustrates a flow state of the ink in the vicinity of the exit. FIG. 11 is an enlarged plan view of a vicinity of an exit in FIG. 9, and illustrates a flow state of the ink in the vicinity of the exit. FIG. 12 is a view corresponding to FIG. 10, an enlarged cross-sectional view of a vicinity of an exit of a flow path member according to Modification Example 1, and illustrates a flow state of the ink in the vicinity of the exit. FIG. 13 is a view corresponding to FIG. 11, an enlarged plan view of a vicinity of an exit of a flow path member according to Modification Example 2, and illustrates a flow state of the ink in the vicinity of the exit.

In FIGS. 10 to 13, the flow direction of the ink is indicated by arrows. In addition, in FIG. 12 corresponding to Modification Example 1 and FIG. 13 corresponding to Modification Example 2, the same reference numerals are given to the same constituent portions as those in Embodiment 1.

As illustrated in FIG. 10, in a case where the ink flows in the second space S2 and is discharged from the exit E2, the ink flows in the +Z axial direction along the inclined surface 66, and the flow direction of the ink changes from the +Z axial direction to the −X axial direction at the exit E2.

Constituent elements (sealing body 46 and wall surface along the X axial direction of the exit E2) which inhibit the flow of ink in the +Z axial direction are disposed on the side in the +Z axial direction of the exit E2, that is, near the end E2T2 of the exit E2. Therefore, on the side in the +Z axial direction of the exit E2, the flow of the ink is inhibited by the constituent elements that inhibit the flow of the ink, and the flow direction of the ink changes from the +Z axial direction to the −X axial direction at the exit E2.

The side in the −Z axial direction of the exit E2, that is, near the end E2T1 of the exit E2 is farther away from the constituent elements which inhibit the flow of the ink as compared with the side in the +Z axial direction of the exit E2, so that the influence of the constituent elements which inhibit the flow of the ink becomes weak. Furthermore, the length of the flow path of the ink flowing near the end E2T1 of the exit E2 is shorter than the length of the flow path of the ink flowing near the end E2T2 of the exit E2, so that the resistance when the ink flows on the side close to the end E2T1 of the exit E2 becomes smaller as compared with that on the side closer to the end E2T2 of the exit E2.

Therefore, the flow of the ink in the side in the −Z axial direction of the exit E2 (side closer to the end E2T1) is less likely to be inhibited as compared with that in the side in the +Z axial direction of the exit E2 (side closer to the end E2T2), and the flow of the ink flowing in the −X axial direction at the exit E2 becomes faster.

Specifically, as illustrated in FIG. 11, the flow of the ink flowing in the −X axial direction at the exit E2 becomes faster in a hatched region R1 (region R1 on the side closer to the end E2T1) in the drawing, and becomes slower in a shaded region R2 (region R2 on the side closer to the end E2T2) in the drawing.

Hereinafter, the region R1 on the side closer to the end E2T1 is referred to as a high flow velocity region R1, and the region R2 on the side closer to the end E2T2 is referred to as a low flow velocity region R2. Furthermore, in the exit E2, the high flow velocity region R1 is disposed between the center E2C and the portion P4 and the low flow velocity region R2 is disposed between the center E2C and the portion P3.

As described above, the end of the space (flow path chamber 3) in which the bottom surface 65 (recessed portion 63) is sealed by the sealing body 46 is the contour 65A of the bottom surface 65 and is the end of the flow path chamber 3. In other words, the portion where the bottom surface 65 and the sealing body 46 are in contact is the contour 65A of the bottom surface 65 and is the end of the flow path chamber 3. Since the ink flows along the end of the flow path chamber 3 (contour 65A of the bottom surface 65), the flow direction of the ink can be controlled by the shape of the end of the flow path chamber 3 (contour 65A of the bottom surface 65).

In the embodiment, the linear portions 65B1 and 65B2 forming the contour 65A of the bottom surface 65 are provided so as to radially extend from the portions P1 and P2 of the exit E2 as starting points, so that the flow direction of the ink flowing in from the entrance E1 is controlled by the linear portions 65B1 and 65B2 and flows so as to collect at the exit E2.

In a case where the exit E2 is provided in the central portion of the bottom surface 65 and does not have linear portions 65B1 and 65B2 radially extending from the exit E2 as a starting point, the ink flowing in from the entrance E1 radially extends from the entrance E1 as a starting point, so that the ink is less likely to collect at the exit E2. Therefore, in the flow path chamber 3, stagnation of the ink in which the ink is less likely to be discharged from the exit E2 occurs.

In the embodiment, even when the ink flowing in from the entrance E1 radially extends from the entrance E1 as the starting point, the ink radially extending from the entrance E1 as the starting point is collected at the exit E2 by the linear portions 65B1 and 65B2 radially extending from the exit E2 as the starting point, so that the ink flowing in from the entrance E1 is discharged from the exit E2 without stagnating in the flow path chamber 3. Therefore, in a case where the bubbles are contained in the ink, the bubbles are likely to be discharged from the exit E2, and the discharge performance of the bubbles can be enhanced.

Furthermore, since the ink collected by the linear portions 65B1 and 65B2 is directed toward the high flow velocity region R1 of the exit E2, the ink is likely to be discharged from the exit E2 as compared with a case where the ink directs toward the low flow velocity region R2 of the exit E2. In a case where the bubbles are contained in the ink, the bubbles are likely to be discharged from the exit E2, and the discharge performance of the bubbles can be further enhanced.

As described above, the flow path member 32 according to the embodiment can obtain the following effects.

(1) Even in a case where the ink flows from the first space S1 toward the second space S2 and the filter FB is bent from the first space S1 toward the second space S2 due to the pressure of the flowing ink, the inclined surface 66 is provided so as not to come into contact with the filter FB. Therefore, the bubbles are confined in a portion where the filter FB and the inclined surface 66 are in contact, and it is possible to suppress the problem that the bubbles are less likely to be discharged from the flow path chamber 3.

(2) When the filter FB is bent from the first space S1 toward the second space S2 due to the pressure of the flowing ink, the cross sectional area of the second space S2 decreases and the flow of the ink flowing through the second space S2 becomes faster as compared with a case where the cross sectional area of the second space S2 is large. Therefore, in a case where the bubbles are contained in the ink flowing into the second space S2, the bubbles are likely to be quickly discharged from the exit E2 without staying in the second space S2, and the discharge performance of the bubbles is enhanced.

(3) In a case where the bubbles are contained in the ink, the bubbles float upward in the gravity direction due to buoyancy. Therefore, when the exit E2 is formed at the uppermost side in the gravity direction of the flow path chamber 3 (bottom surface 65), the bubbles floating upward in the gravity direction due to buoyancy are likely to be discharged.

(4) When the linear portions 65B1 and 65B2 radially extending from the exit E2 as the starting point are provided, the ink flowing in from the entrance E1 and radially extending from the entrance E1 as the starting point is collected at the exit E2 by the linear portions 65B1 and 65B2. Therefore, the ink is likely to be discharged from the exit E2, and in the case where the bubbles are contained in the ink, the bubbles are likely to be discharged from the exit E2, so that the discharge performance of the bubbles can be enhanced.

(5) Since the ink collected by the linear portions 65B1 and 65B2 is directed toward the high flow velocity region R1 of the exit E2, the ink is likely to be discharged from the exit E2, as compared with a case where the ink directs toward the low flow velocity region R2 of the exit E2. In the case where the bubbles are contained in the ink, the bubbles are likely to be discharged from the exit E2, and the discharge performance of the bubbles can be enhanced.

(6) According to (1) to (5) described above, the discharge performance of the bubbles of the flow path member 32 can be enhanced. Therefore, in the printing apparatus 10 having the flow path member 32 in which the discharge performance of the bubbles is enhanced, a bad effect of the bubbles, for example, a problem that the ink is not properly ejected by the bubbles are suppressed.

Modification Example 1

As illustrated in FIG. 12, in a flow path member 32A according to Modification Example 1, an exit E2 is disposed away from an end of a bottom surface 65 inside a contour 65A of the bottom surface 65, and the exit E2 does not protrude in the +Z axial direction. On the other hand, in the flow path member 32 according to the embodiment, the exit E2 is disposed at the end of the bottom surface 65, and the exit E2 protrudes in the +Z axial direction on the bottom surface 65. This point is a difference between the flow path member 32A according to Modification Example 1 and the flow path member 32 according to the embodiment, and the other configuration is the same as each other.

Similar to the flow path member 32 according to the embodiment, in the flow path member 32A according to Modification Example 1, in a case where ink flows through a second space S2 and is discharged from the exit E2, as indicated by arrows in the drawing, the ink flows in the +Z axial direction along an inclined surface 66, and the flow direction of the ink changes from the +Z axial direction to the −X axial direction at the exit E2.

However, since an end E2T2 of the exit E2 is disposed away from the end of the bottom surface 65 (contour 65A of bottom surface 65), a region R3 (region where ink stagnates) where the ink is less likely to flow and indicated by the two-dot chain line in the drawing is generated between the end E2T2 of the exit E2 and the end of the bottom surface 65 (contour 65A of bottom surface 65). Therefore, in a case where the bubbles are contained in the ink, a portion of the ink containing the bubbles is likely to stay in the region R3, the bubbles staying in the region R3 are less likely to be discharged from the exit E2, and the discharge performance of the bubbles deteriorates.

On the other hand, in the flow path member 32 according to the embodiment, the exit E2 is disposed at the end of the bottom surface 65, and the above region R3 where the ink is less likely to flow is not generated between the end E2T2 of the exit E2 and the end of the bottom surface 65 (contour 65A of bottom surface 65). The ink is likely to be discharged from the exit E2 as compared with the case where the region R3 where the ink is less likely to flow is generated, and in a case where the bubbles are contained in the ink, the bubbles are likely to be discharged. Therefore, in order that the bubbles are contained in the ink and the bubbles are likely to be discharged from the exit E2, the configuration of the flow path member 32 according to the embodiment, that is, the configuration in which the end E2T2 of the exit E2 is disposed at the end of the bottom surface 65 (contour 65A of bottom surface 65) is preferable.

In the configuration in which the exit E2 protrudes in the +Z axial direction on the bottom surface 65 (flow path member 32 according to the embodiment), the dimension in the +Z axial direction (dimension in the height direction) becomes longer as compared with the configuration in which the exit E2 does not protrude in the +Z axial direction on the bottom surface 65 (configuration according to Modification Example 1). In order to shorten the dimension in the +Z axial direction (dimension in the height direction), the configuration in which the exit E2 does not protrude in the +Z axial direction on the bottom surface 65 (flow path member 32A according to Modification Example 1) is preferable.

Furthermore, in the flow path member 32A according to Modification Example 1, the effects (1), (2), and (4) of the flow path member 32 according to Embodiment 1 described above can be obtained, so that the discharge performance of the bubbles of the flow path member 32A can be enhanced at a level that can be put to practical use. In the printing apparatus 10 having the flow path member 32A according to the modification example, a bad effect of the bubbles, for example, a problem that the ink is not properly ejected by the bubbles is suppressed.

Modification Example 2

As illustrated in FIG. 13, in the flow path member 32B according to Modification Example 2, portions P1 and P2 of the exit E2 are positioned on the side in the +Z axial direction with respect to a center E2C of the exit E2. In the flow path member 32 according to the embodiment, the portions P1 and P2 of the exit E2 are positioned on the side in the −Z axial direction with respect to the center E2C of the exit E2. This point is a difference between the flow path member 32B according to Modification Example 2 and the flow path member 32 according to the embodiment, and the other configuration is the same as each other.

In the flow path member 32B according to Modification Example 2, since the portions P1 and P2 of the exit E2 are positioned on the side in the +Z axial direction with respect to the center E2C of the exit E2, a portion of the ink collected by the linear portions 65B1 and 65B2 is likely to direct toward the low flow velocity region R2 of the exit E2. Therefore, in the flow path member 32B according to the modification example, the portion of the ink is likely to be discharged from the low flow velocity region R2 of the exit E2.

In the flow path member 32 according to the embodiment, since the portions P1 and P2 of the exit E2 are positioned on the side in the −Z axial direction with respect to the center E2C of the exit E2, the ink collected by the linear portions 65B1 and 65B2 is likely to direct toward the high flow velocity region R1 of the exit E2 and is less likely to direct toward the low flow velocity region R2 of the exit E2. Therefore, in the flow path member 32 according to the embodiment, the ink is likely to be discharged from the high flow velocity region R1 at the exit E2, in a case where the bubbles are contained in the ink, the bubbles are likely to be discharged from the exit E2 as compared with a case where the portion of the ink is likely to be discharged from the low flow velocity region R2 at the exit E2, and the discharge performance of the bubbles can be enhanced.

Therefore, in order that the bubbles are contained in the ink and the bubbles are likely to be discharged from the exit E2, the configuration of the flow path member 32 according to the embodiment, that is, the configuration in which the portions P1 and P2 of the exit E2 are positioned on the side in the −Z axial direction with respect to the center E2C of the exit E2 is preferable.

On the other hand, in the configuration in which the portions P1 and P2 of the exit E2 are positioned on the side in the −Z axial direction with respect to the center E2C of the exit E2 on the bottom surface 65 (flow path member 32 according to the embodiment), the dimension in the +Z axial direction (dimension in the height direction) becomes longer as compared with the configuration in which the portions P1 and P2 of the exit E2 are positioned on the side in the +Z axial direction with respect to the center E2C of the exit E2 (flow path member 32B according to Modification Example 2). In order to shorten the dimension in the +Z axial direction (dimension in the height direction), the configuration in which the portions P1 and P2 of the exit E2 are positioned on the side in the +Z axial direction with respect to the center E2C of the exit E2 on the bottom surface 65 (flow path member 32B according to Modification Example 2) is preferable.

Furthermore, in the flow path member 32B according to Modification Example 2, the effects (1) to (4) of the flow path member 32 according to Embodiment 1 described above can be obtained, so that the discharge performance of the bubbles of the flow path member 32B can be enhanced at a level that can be put to practical use. In the printing apparatus 10 having the flow path member 32B according to the modification example, a bad effect of the bubbles, for example, a problem that the ink is not properly ejected by the bubbles is suppressed.

Embodiment 2

Figure 14:
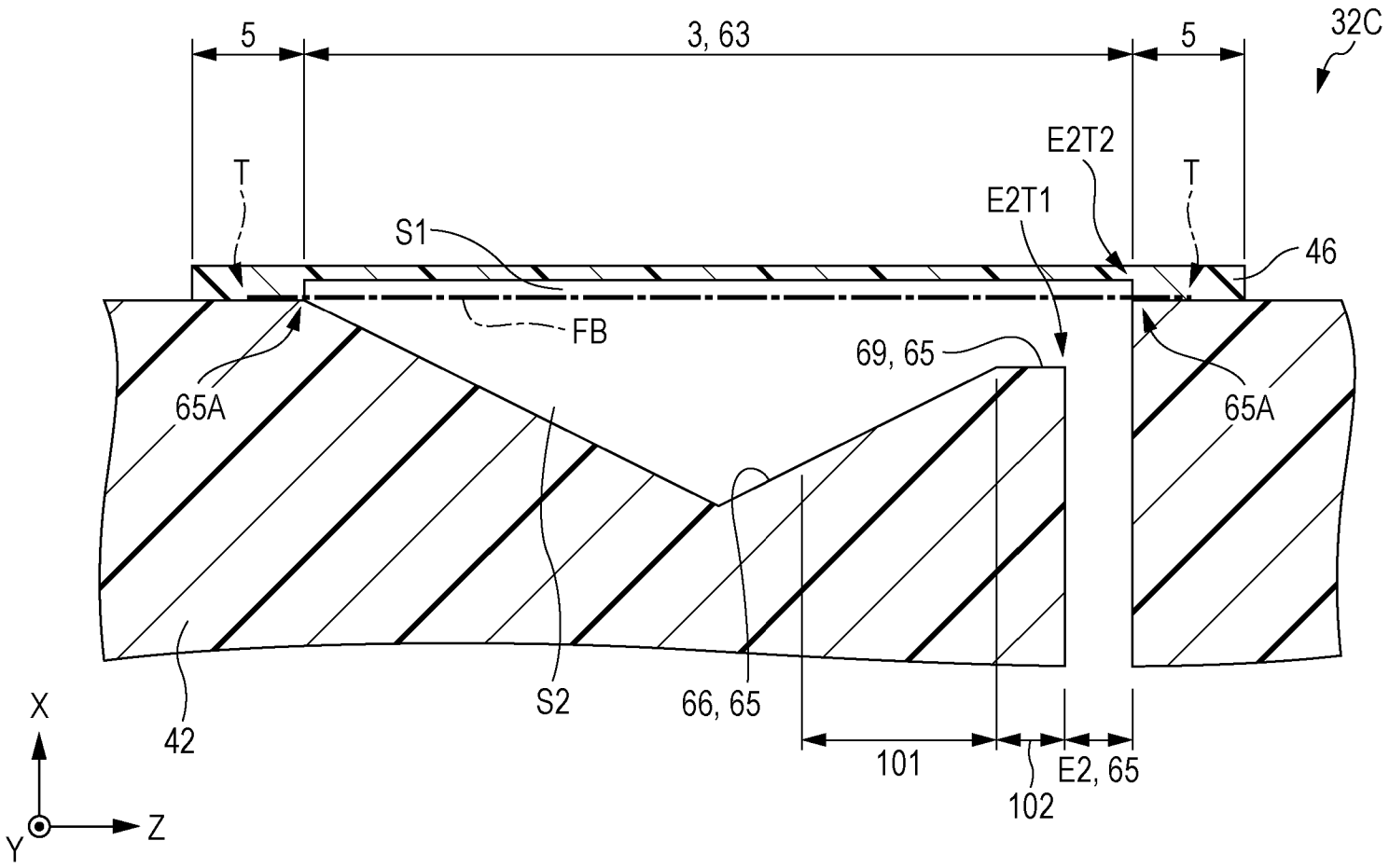
FIG. 14 is a cross-sectional view of the flow path member according to Embodiment 2.
Figure 15:
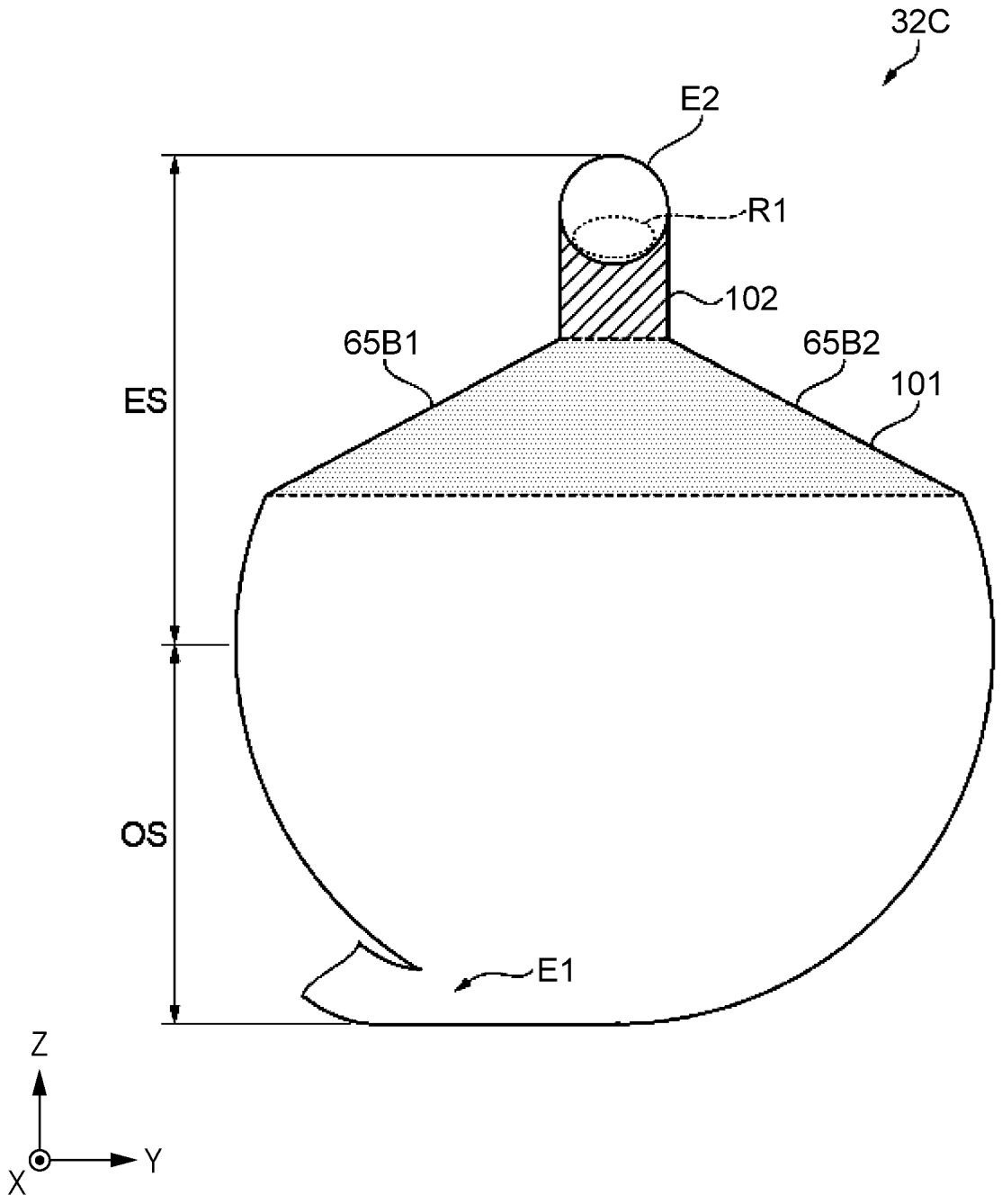
FIG. 15 is a plan view illustrating a state of a bottom surface of the flow path member according to the embodiment.

FIG. 14 is a view corresponding to FIG. 7, and a cross-sectional view of the flow path member according to Embodiment 2. FIG. 15 is a view corresponding to FIG. 9, and a plan view illustrating a state of a bottom surface of the flow path member according to the embodiment. In FIG. 15, a shaded region is a first portion 101 gradually decreasing on an exit side ES, a white circle is an exit E2, and a hatched region is a second portion 102 connecting the exit ES and the first portion 101 to each other.

In the flow path member 32C according to the embodiment, the exit E2 and the first portion 101 gradually decreasing on the exit side ES are separated from each other. In the flow path member 32 according to Embodiment 1, the exit E2 and the first portion 101 gradually decreasing on the exit side ES are in contact with each other. This point is a difference between the embodiment and Embodiment 1.

Hereinafter, with reference to FIGS. 14 and 15, the flow path member 32C according to the embodiment will be described focusing on a difference from Embodiment 1. In addition, the same components as those in Embodiment 1 are denoted by the same reference numerals, and redundant descriptions are omitted.

As illustrated in FIGS. 14 and 15, the flow path member 32C according to the embodiment is provided with a filter FB, a first space S1 provided with an entrance E1 into which ink flows, a second space S2 having a bottom surface 65 separated from the first space S1 by the filter FB and facing the filter FB, and an exit E2 provided on the bottom surface 65 and through which the ink flows out. In a case where the filter FB is viewed in plan view, the width of the bottom surface 65 (dimension in the Y axial direction of the bottom surface 65) is gradually decreased with respect to the exit side ES than the side opposite thereto OS.

The bottom surface 65 has the first portion 101 of which the width (dimension in the Y axial direction of the bottom surface 65) gradually decreases on the exit side ES, an exit E2, and the second portion 102 connecting the exit E2 and the first portion 101 to each other. The bottom surface 65 of the first portion 101 is an inclined surface 66 that intersects the Z axial direction. The bottom surface 65 of the second portion 102 is a vertical surface 69 along the Z axial direction. The bottom surface 65 of the second portion 102 may be a surface that intersects with the Z axial direction instead of the vertical surface 69 along the Z axial direction.

The exit E2 is disposed at a distance from the first portion 101 gradually decreasing on the exit side ES and the exit E2 and the first portion 101 are connected to each other by the second portion 102. The width of the second portion 102 (dimension of the second portion 102 in the Y axial direction) is the same as the width of the exit E2 (diameter of the exit E2). A high flow velocity region R1 is disposed on the second portion 102 side of the exit E2.

The linear portions 65B1 and 65B2 are provided so as to radially extend from the end on the side in the −Z axial direction of the second portion 102 (boundary between the second portion 102 and the first portion 101 side) as a starting point. Therefore, the ink flowing in from the entrance E1 is collected at the end on the side in the −Z axial direction of the second portion 102 by the linear portions 65B1 and 65B2, flows from the end on the side in the −Z axial direction of the second portion 102 toward the end on the side in the +Z axial direction of the second portion 102, and reaches the high flow velocity region R1 at the exit E2.

The second portion 102 plays a role of aligning the flow direction of the ink in the direction toward the high flow velocity region R1 of the exit E2 and guiding the ink to the high flow velocity region R1 of the exit E2. When the flow direction of the ink is aligned in the direction toward the high flow velocity region R1 of the exit E2, the ink is likely to flow, the flow of the ink becomes faster, and the ink is likely to be discharged from the exit E2, as compared with a case where the flow direction is not aligned in the direction toward the high flow velocity region R1 of the exit E2 (for example, case where turbulent flow of ink occurs). In a case where the bubbles are contained in the ink, the bubbles are likely to be discharged from the exit E2, and the discharge performance of the bubbles can be enhanced.

In this manner, in the flow path member 32C according to the embodiment, in addition to the effects (1) to (5) of the flow path member 32 according to Embodiment 1 described above, the flow direction of the ink towards the exit E2 is aligned, the ink is likely to flow, and the flow of the ink becomes faster. In the case where the bubbles are contained in the ink, the bubbles are likely to be discharged from the exit E2, and the discharge performance of the bubbles can be enhanced. In the printing apparatus 10 having the flow path member 32C according to the embodiment, a bad effect of the bubbles, for example, a problem that the ink is not properly ejected by the bubbles is suppressed.

The invention is not limited to the above-described embodiment, and can be appropriately changed within a scope not contrary to the gist or idea of the invention which can be read from the aspects and the entire specification, and various modification examples other than the above embodiment are conceivable. Hereinafter, the modification examples will be described.

Modification Example 3

Figure 16:
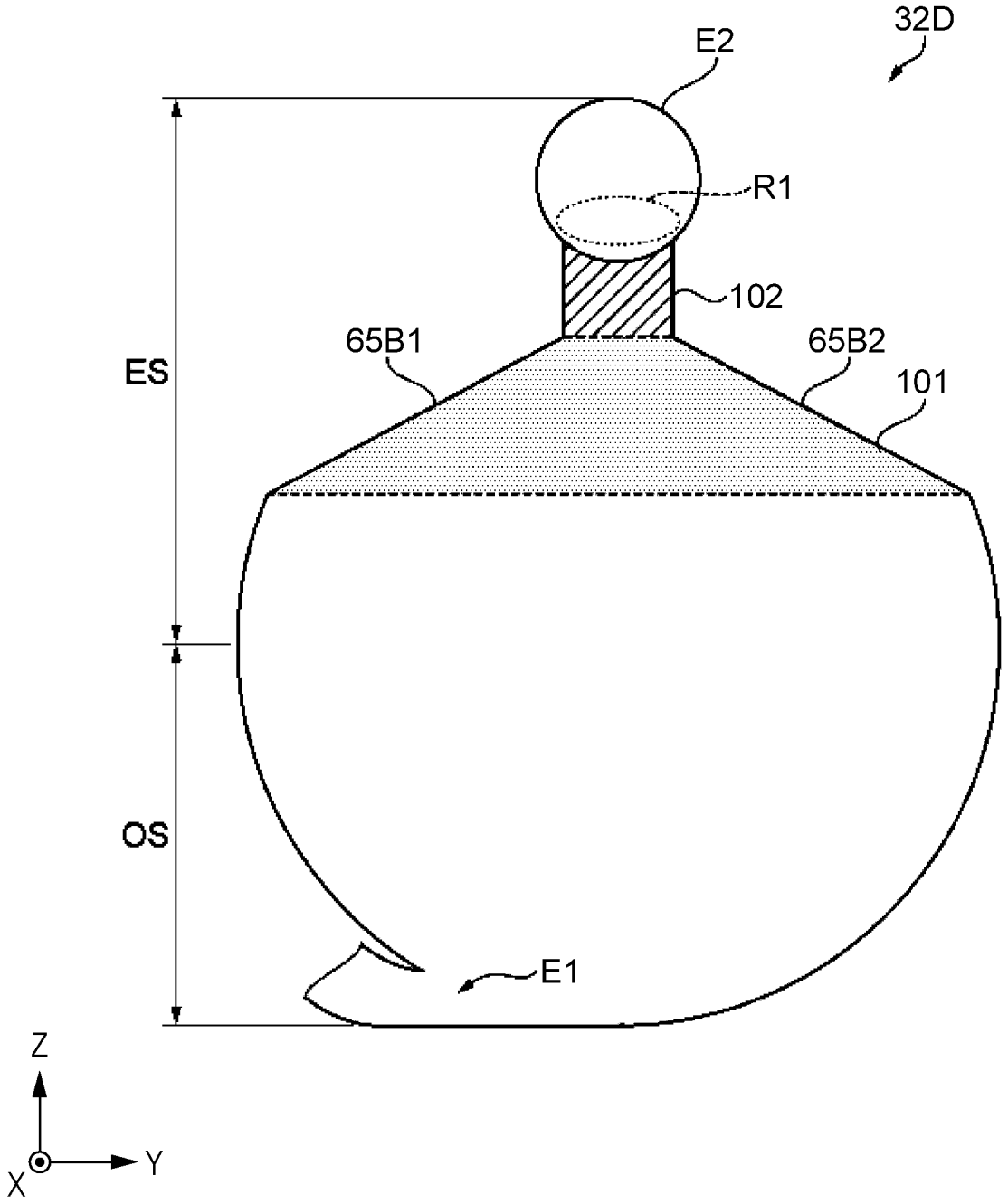
FIG. 16 is a plan view illustrating a state of a bottom surface of a flow path member according to Modification Example 3.

FIG. 16 is a view corresponding to FIG. 15, and a plan view illustrating a state of a bottom surface of a flow path member according to Modification Example 3. In the modification example, the width of the exit E2 (diameter of the exit E2) is longer than the width of the second portion 102 (dimension in the Y axial direction of the second portion 102). This point is a difference between the modification example and Embodiment 2.

The same components as those in Embodiment 2 are denoted by the same reference numerals, and redundant descriptions are omitted. Hereinafter, with reference to FIG. 16, a difference from Embodiment 2 will be mainly described.

As illustrated in FIG. 16, in a flow path member 32D according to the modification example, the width of the exit E2 is longer than the width of the second portion 102 and the width of the high flow rate region R1 (dimension in the Y axial direction of the high flow velocity region R1) is longer than the width of the second portion 102. Since the width of the high flow velocity region R1 is longer than the width of the second portion 102, as compared with a case where the width of the high flow velocity region R1 is the same as the width of the second portion 102, the ink collected by the linear portions 65B1 and 65B2 is stably guided to the high flow velocity region R1 of the exit E2 and is reliably discharged from the high flow velocity region R1 of the exit E2. Therefore, it is possible to reliably discharge the ink containing the bubbles from the high flow rate region R1 of the exit E2.

That is, in the flow path member 32D according to the modification example, the effect (5) of the flow path member 32 according to Embodiment 1 described above can be stably and reliably obtained. As a matter of course, in the flow path member 32D according to the modification example, the effects (1) to (4) of the flow path member 32 according to Embodiment 1 described above can be obtained, so that in a case where the bubbles are contained in the ink, the bubbles are likely to be discharged from the exit E2, and the discharge performance of the bubbles can be enhanced. In the printing apparatus 10 having the flow path member 32D according to the modification example, a bad effect of the bubbles, for example, a problem that the ink is not properly ejected by the bubbles is suppressed.

Even in a case where the width of the exit E2 (diameter of the exit E2) is shorter than the width of the second portion 102 (dimension in the Y axial direction of the second portion 102) and a portion of the ink is likely to be discharged from the low flow velocity region R2 of the exit E2, similarly to the flow path member 32B according to Modification Example 2, the discharge performance of the bubbles can be enhanced to a level that can be put into practical use.

That is, the width of the exit E2 may be the same as the width of the second portion 102, the width of the exit E2 may be longer than the width of the second portion 102, and the width of the exit E2 may be shorter than the width of the second portion 102.

Modification Example 4

Figure 17:
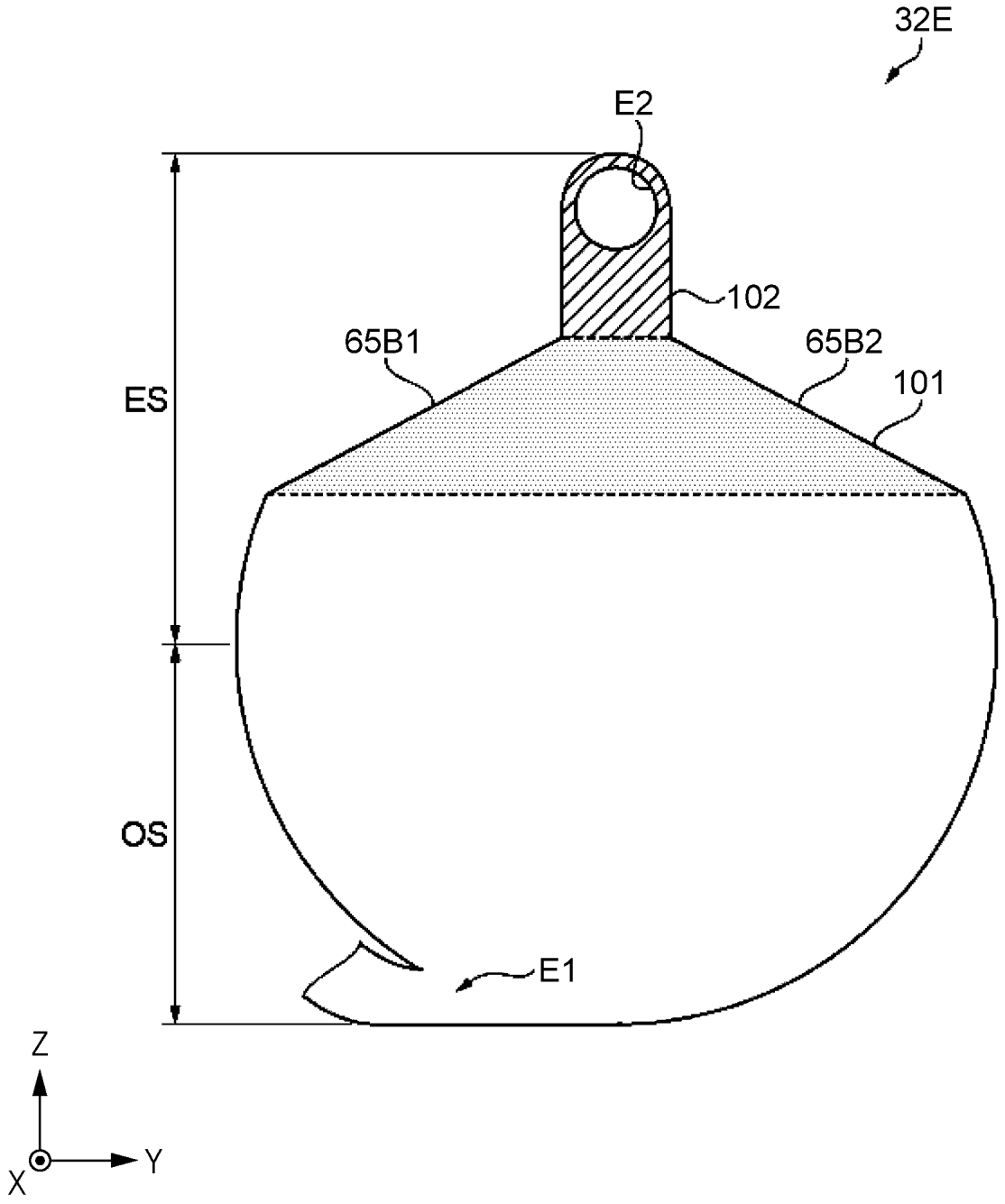
FIG. 17 is a plan view illustrating a state of a bottom surface of a flow path member according to Modification Example 4.

FIG. 17 is a view corresponding to FIG. 15, and a plan view illustrating a state of a bottom surface of a flow path member according to Modification Example 4.

As illustrated in FIG. 17, in the flow path member 32E according to the modification example, the exit E2 is disposed inside the second portion 102. This point is a difference between the modification example and Embodiment 2.

When the exit E2 is disposed inside the second portion 102, the flow direction of the ink toward the exit E2 is aligned, the ink is likely to flow, and the flow of the ink becomes faster. Therefore, in a case where the bubbles are contained in the ink, the bubbles are likely to be discharged from the exit E2, and the discharge performance of the bubbles can be enhanced.

As a matter of course, in the flow path member 32E according to the modification example, the effects (1) to (4) of the flow path member 32 according to Embodiment 1 described above can be obtained. In the printing apparatus 10 having the flow path member 32E according to the modification example, a bad effect of the bubbles, for example, a problem that the ink is not properly ejected by the bubbles is suppressed.

Modification Example 5

Figure 18:
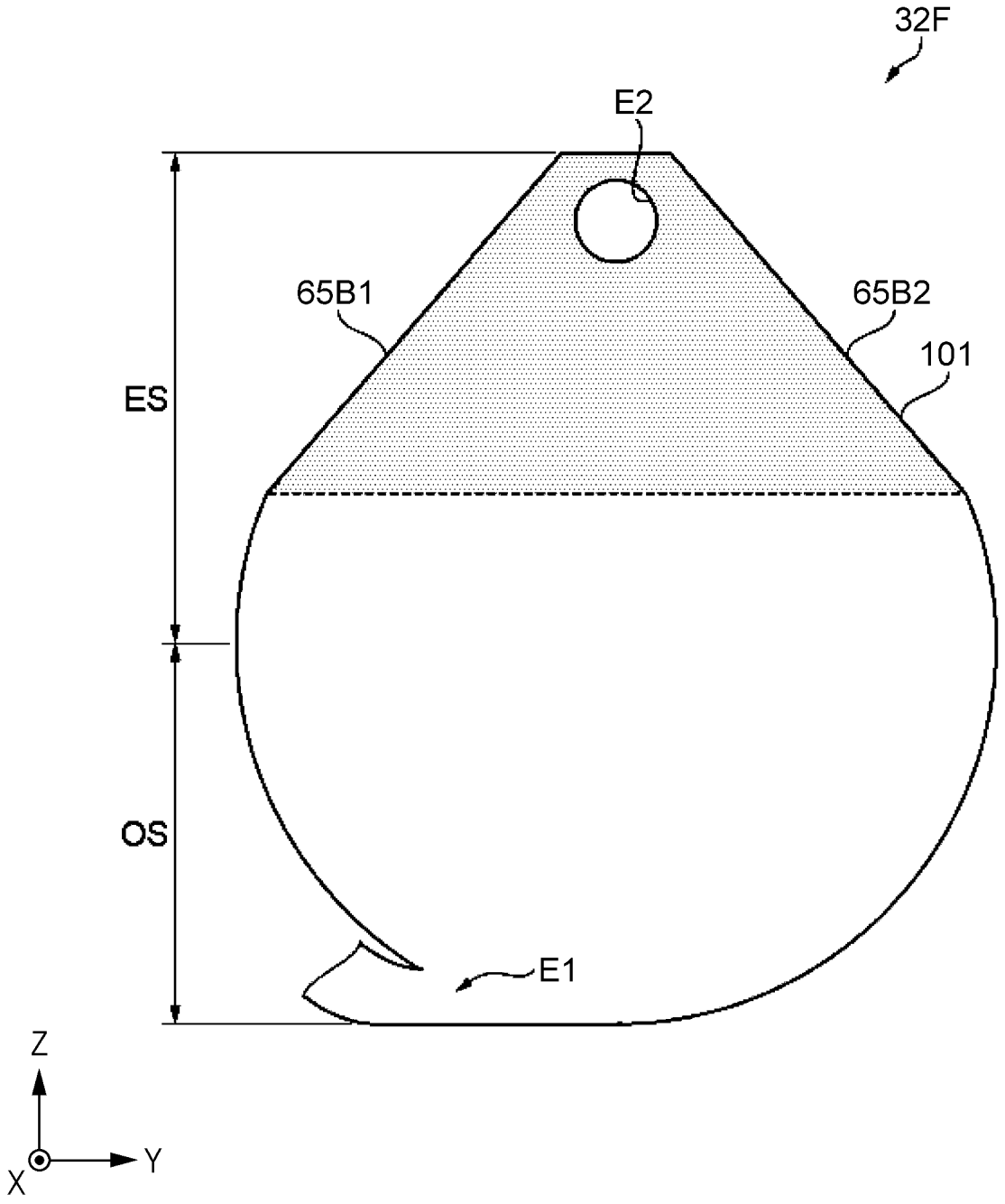
FIG. 18 is a plan view illustrating a state of a bottom surface of a flow path member according to Modification Example 5.

FIG. 18 is a view corresponding to FIG. 15, and a plan view illustrating a state of a bottom surface of a flow path member according to Modification Example 5.

As illustrated in FIG. 18, in a flow path member 32F according to the modification example, the exit E2 is disposed inside the first portion 101, and the second portion 102 is not provided. This point is a difference between the modification example and Embodiment 2. Even in a case where the exit E2 is disposed inside the first portion 101, the ink is collected in the direction toward the exit E2 by the linear portions 65B1 and 65B2, so that in a case where the bubbles are contained in the ink, the bubbles are likely to be discharged from the exit E2, and the discharge performance of the bubbles can be enhanced.

Modification Example 6

In Embodiment 1, the flow path member 32 is vertically placed so that the dimension in the width direction is short and the dimension in the height direction is long. The flow path member 32 may be horizontally placed so that the dimension in the width direction is long and the dimension in the height direction is short.

When the flow path member 32 is horizontally placed, the entrance E1 is disposed on the upper side in the gravity direction and the exit E2 is disposed on the lower side in the gravity direction, since the ink is likely to flow in the weight direction, the ink is likely to flow from the entrance E1 disposed on the upper side in the gravity direction to the exit E2 disposed on the lower side in the gravity direction. In a case where the bubbles are contained in the ink, the bubbles are likely to be discharged from the exit E2, and the discharge performance of the bubbles can be enhanced.

Furthermore, the flow path member according to the embodiments and the modification examples described above can be applied to a printing apparatus (liquid ejecting apparatus) different from the printing apparatus 10. For example, the invention can be applied to a color material ejecting apparatus having a color material ejecting head used for manufacturing a color filter such as a liquid crystal display, an electrode material ejecting apparatus having an electrode material ejecting head used for forming electrodes such as organic electro luminescence (EL) display and field emission display (FED), a bioorganic material ejecting apparatus having a bioorganic ejecting head used for manufacturing a biochip (biochemical element), and the like.

In addition, in the embodiments and the modification examples described above, the inclined surface 66 of the bottom surface 65 forming the flow path chamber 3 includes not only a flat surface but also a curved surface.

Modification Example 7

Figure 19:
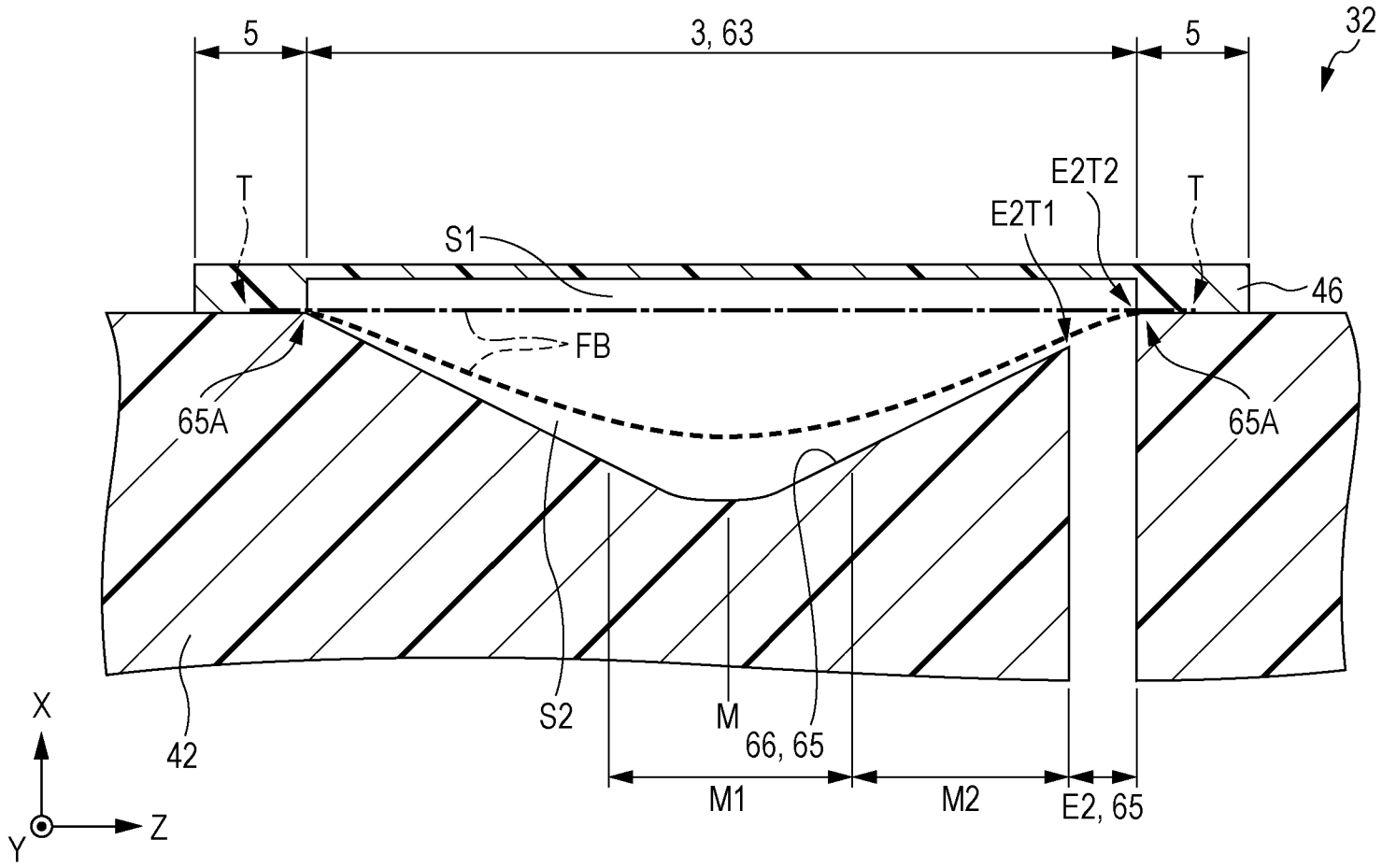
FIG. 19 is a cross-sectional view of a bottom surface of a flow path member according to Modification Example 7 taken along line XIX-XIX in FIG. 6.
Figure 20:
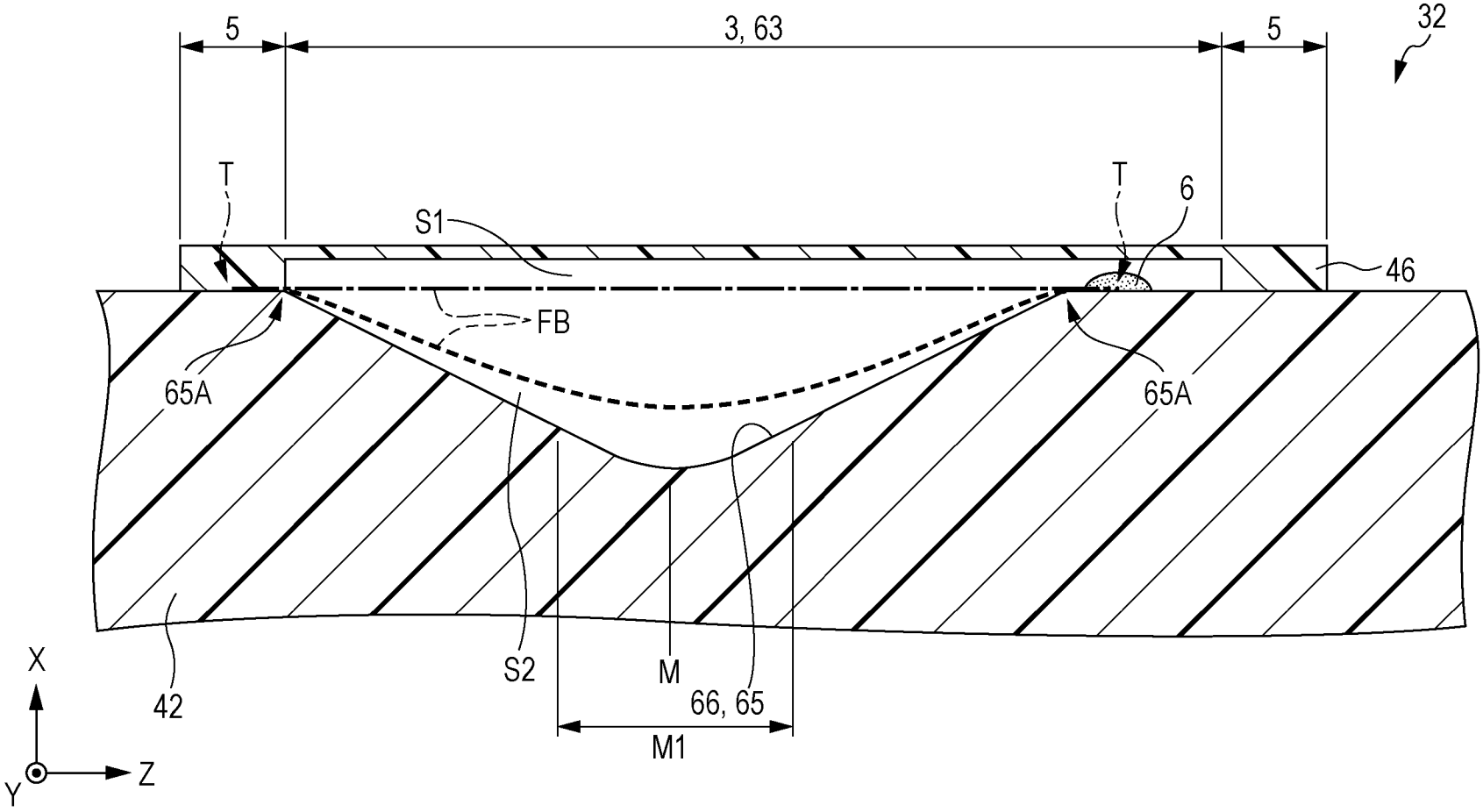
FIG. 20 is a cross-sectional view of the bottom surface of the flow path member according to Modification Example 7 taken along line XX-XX in FIG. 6.

FIG. 19 is a cross-sectional view of the bottom surface 65 of the flow path member 32 according to Modification Example 7 taken along line XIX-XIX in FIG. 6. FIG. 20 is a cross-sectional view of the bottom surface of the flow path member according to Modification Example 7 taken along line XX-XX in FIG. 6. As illustrated in FIGS. 19 and 20, a range M1 including a portion M of the bottom surface 65 which is most spaced away from the filter FA is a curved surface in which the filter FA side is recessed. According to the configuration, since the portion M spaced away from the filter FA becomes a curved surface, the bubbles are hardly caught in the portion M, so that the discharge performance of the bubbles can be improved.

In addition, the portion M of the bottom surface 65 most spaced away from the filter FA may be the curved surface and a flat surface inclined so as to approach the filter FA may be continuous with the curved surface between the portion M and the exit E2. In FIG. 19, the range M1 of the bottom surface 65 is the curved surface, and a range M2 continuing to the range M1 is inclined to the exit E2 so as to be a flat surface inclined. With such a configuration, since the cross sectional area of the range M2 can be made smaller than the cross sectional area of the range M1 between the portion M which is most spaced away from the filter FA and the exit E2 of the bottom surface 65, the flow velocity can be increased to the exit E2, so that the discharge performance of the bubbles can be improved. The cross sectional area here is a cross section that intersects in a direction from the portion M most spaced away from the filter FA toward the exit E2, specifically, a cross sectional area of the cross section taken along the X-Y plane. The range M2 of the bottom surface 65 may be a curved surface having a larger curvature than the curved surface of the range M1. With this configuration, since the cross sectional area of the range M2 can be made smaller than the cross sectional area of the range M1 between the portion M which is most spaced away from the filter FA and the exit E2, the flow velocity can be increased to the exit E2, so that the discharge performance of the bubbles can be improved.

This application claims priority to Japanese Patent Application No. 2017-081134 filed on Apr. 17, 2017 and Japanese Patent Application No. 2017-252174 filed on Dec. 27, 2017. The entire disclosures of Japanese Patent Application Nos. 2017-081134 and 2017-252174 are hereby incorporated herein by reference.

What is claimed is:

1. A flow path member comprising:

a filter;

a first space provided with an entrance through which a liquid flows in;

a second space separated from the first space by the filter and that has a bottom surface facing the filter; and an exit disposed on the bottom surface and through which the liquid flows out, wherein the bottom surface includes an inclined surface spaced away gradually from the filter from an end of the filter toward a center in a case where the filter is viewed in plan view, wherein a contour of the bottom surface includes a first contour forming a contour of the exit, a second contour different from the contour of the exit, and an intersection point of the first contour and the second contour, wherein, in a case where a direction from a portion of the second contour farthest from the intersection point toward a portion of the first contour farthest from the intersection point is set as a first direction, wherein the first contour is positioned on a side in the first direction with respect to the intersection point, and wherein a width between a first edge of the second contour and a second edge of the second contour, the second edge being opposite to the first edge in a cross direction crossing to the first direction, gradually increases along a second direction which is opposite to the first direction, from the intersection point to a predetermined point in the second direction.

2. The flow path member according to claim 1, wherein a width of the bottom surface gradually decreases with respect to an exit side than a side opposite thereto in the case where the filter is viewed in the plan view.

3. The flow path member according to claim 1, wherein the bottom surface includes a first portion where a width gradually decreases on the exit side, and a second portion that connects the exit and the first portion to each other and has the same width as that of the exit.

4. The flow path member according to claim 1, wherein the intersection point is positioned on a side opposite to the first direction with respect to a center of the exit.

5. The flow path member according to claim 1, wherein a fixing portion fixed to an end of the filter is provided on an outer side of an outer shape of the bottom surface in the case where the filter is viewed in the plan view.

6. The flow path member according to claim 1, wherein the filter is disposed along a direction intersecting a horizontal plane.

7. The flow path member according to claim 6, wherein the exit is positioned at an uppermost side in a gravity direction on the bottom surface.

8. The flow path member according to claim 1, wherein the inclined surface is along a deflection from the first space to the second space in a case where the liquid flows from the first space to the second space and the filter deflects from the first space toward the second space.

9. The flow path member according to claim 1, wherein a portion that is most spaced away from the filter of the bottom surface is a curved surface.

10. The flow path member according to claim 9, wherein (i) a flat surface inclined so as to approach the filter is continuous with the curved surface or, alternatively, (ii) a different curved surface, which has a larger curvature than the curved surface, is continuous with the curved surface between the portion that is most spaced away from the filter and the exit of the bottom surface.

11. The flow path member according to claim 1, wherein the bottom surface includes a first portion and a second portion that connects the exit and the first portion, a contour of the bottom surface includes the first contour and the second contour, and a fixing portion fixed to an end of the filter is provided on an outer side of an outer shape of the bottom surface in the case where the filter is viewed in the plan view.

12. The flow path member according to claim 11, wherein a portion that is most spaced away from the filter of the bottom surface is a curved surface.

13. The flow path member according to claim 12, wherein a contour of the bottom surface includes a first contour forming a contour of the exit, a second contour different from the contour of the exit, and an intersection point of the first contour and the second contour, and in a case where a direction from a portion of the second contour farthest from the intersection point toward a portion of the first contour farthest from the intersection point is set as a first direction, the first contour is positioned on a side in the first direction with respect to the intersection point.

14. The flow path member according to claim 13, wherein the filter is disposed along a direction intersecting a horizontal plane.

15. The flow path member according to claim 14, wherein a flat surface inclined so as to approach the filter is continuous with the curved surface or a curved surface having a larger curvature than the curved surface is continuous with the curved surface between the portion that is most spaced away from the filter and the exit of the bottom surface.

16. The flow path member according to claim 14, wherein the bottom surface includes a first portion where a width gradually decreases on the exit side, and a second portion that connects the exit and the first portion to each other and has the same width as that of the exit.

17. A liquid ejecting apparatus comprising:

the flow path member according to claim 1; and a nozzle that ejects a liquid from the flow path member.

18. The flow path member according to claim 1, wherein the width between the first edge and the second edge gradually decreases along the second direction from the predetermined point.

19. A flow path member comprising:

a filter;

a first space provided with an entrance through which a liquid flows in;

a second space separated from the first space by the filter and that has a bottom surface facing the filter; and an exit disposed on the bottom surface and through which the liquid flows out, wherein the bottom surface includes an inclined surface spaced away gradually from the filter from an end of the filter toward a center in a case where the filter is viewed in plan view, wherein a contour of the bottom surface includes a first contour forming a contour of the exit, a second contour different from the contour of the exit, and an intersection point of the first contour and the second contour, and wherein the bottom surface includes a first portion and a second portion that connects the exit and the first portion, a contour of the bottom surface includes the first contour and the second contour, and a fixing portion fixed to an end of the filter is provided on an outer side of an outer shape of the bottom surface in the case where the filter is viewed in the plan view.

20. The flow path member according to claim 19, wherein a portion that is most spaced away from the filter of the bottom surface is a curved surface.

* * * * *